US010006693B2

(12) United States Patent
Ramm et al.

(10) Patent No.: US 10,006,693 B2
(45) Date of Patent: Jun. 26, 2018

(54) APPLIANCE MODULAR SYSTEM FOR INCORPORATING A PANTRY COMPARTMENT WITHIN AN APPLIANCE

(71) Applicant: Whirlpool Corporation, Benton Harbor, MI (US)

(72) Inventors: Axel Julio Ramm, St. Joseph, MI (US); Michael S. Richards, St. Joseph, MI (US); Rahul Wadke, St. Joseph, MI (US); Joshua J. Wittes, Berrien Springs, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 336 days.

(21) Appl. No.: 14/920,070

(22) Filed: Oct. 22, 2015

(65) Prior Publication Data

US 2017/0115051 A1 Apr. 27, 2017

(51) Int. Cl.

| | |
|---|---|
| ***F25D 23/00*** | (2006.01) |
| ***F25D 29/00*** | (2006.01) |
| ***F25D 25/02*** | (2006.01) |
| ***F25D 23/06*** | (2006.01) |

(52) U.S. Cl.

CPC ..... *F25D 25/025* (2013.01); *F25D 23/069* (2013.01); *A47B 2210/175* (2013.01); *F25D 2323/021* (2013.01); *F25D 2400/04* (2013.01); *F25D 2400/06* (2013.01)

(58) Field of Classification Search

CPC ..... Y10T 29/49359; Y10T 29/49826; Y10T 29/49876; Y10T 29/4987; Y10T 29/49716; B23P 15/26; F25D 25/025; F25D 23/069; A47B 2210/17

USPC ..... 312/404, 402, 407, 408

See application file for complete search history.

(56) References Cited

U.S. PATENT DOCUMENTS

| | | | |
|---|---|---|---|
| 4,090,753 | A | 5/1978 | Rock et al. |
| 4,589,710 | A | 5/1986 | Rock et al. |
| 4,595,245 | A | 6/1986 | Rock et al. |
| 4,690,469 | A | 9/1987 | Grass |
| 4,705,328 | A | 11/1987 | Rock et al. |
| 5,147,124 | A | 9/1992 | Grass et al. |
| 6,390,576 | B1 | 5/2002 | Walburn |

(Continued)

*Primary Examiner* — Jason L Vaughan
*Assistant Examiner* — Amanda Meneghini
(74) *Attorney, Agent, or Firm* — Price Heneveld LLP

(57) ABSTRACT

A refrigerating appliance includes an interior volume divided by a medial wall into refrigerating and freezing compartments. A horizontal false mullion extends through one of the compartments, parallel with the medial wall to define a pantry compartment in thermal communication with at least one of the refrigerating and freezing compartments. A center vertical mullion is removably engaged with the medial wall and divides the pantry compartment into first and second pantry sub compartments. First and second outer drawer glides are positioned on the cabinet structure within the pantry compartment and opposite first and second inner drawer glides of the center vertical mullion. The first inner and first outer drawer glides partially define the first pantry sub compartment. The second inner and second outer drawer glides partially define the second pantry sub compartment. First and second pantry drawers are slidably engaged with first and second pantry sub compartments, respectively.

20 Claims, 15 Drawing Sheets

(56) References Cited

U.S. PATENT DOCUMENTS

| | | | | |
|---|---|---|---|---|
| 6,447,083 | B1 | 9/2002 | Chiapetta et al. | |
| 6,742,353 | B2 * | 6/2004 | Ohashi | F25D 17/04 62/405 |
| 7,475,562 | B2 | 1/2009 | Jackovin | |
| 8,215,730 | B2 | 7/2012 | Brown et al. | |
| 8,231,190 | B2 | 7/2012 | Ertz et al. | |
| 8,328,301 | B2 | 12/2012 | Lee et al. | |
| 8,382,219 | B2 | 2/2013 | Hottmann et al. | |
| 8,408,663 | B2 | 4/2013 | Chellappan et al. | |
| 8,474,928 | B2 | 7/2013 | Ertz et al. | |
| 8,511,767 | B2 | 8/2013 | Haidar et al. | |
| 8,783,800 | B2 | 7/2014 | Benigni | |
| 8,789,902 | B2 | 7/2014 | Hottmann et al. | |
| 8,875,538 | B2 | 11/2014 | Lee et al. | |
| 8,955,352 | B2 | 2/2015 | Lee et al. | |
| 9,039,110 | B2 | 5/2015 | Haltmeyer et al. | |
| 9,074,810 | B2 | 7/2015 | Hwang et al. | |
| 2008/0074019 | A1 | 3/2008 | Park et al. | |
| 2009/0167130 | A1 | 7/2009 | Chellappan et al. | |
| 2010/0090575 | A1 | 4/2010 | Uthuppan | |
| 2010/0320890 | A1 | 12/2010 | Jung et al. | |
| 2011/0146325 | A1 | 6/2011 | Lee | |
| 2011/0146326 | A1 | 6/2011 | Choi | |
| 2011/0309732 | A1 * | 12/2011 | Horil | A47B 88/10 312/404 |
| 2012/0091874 | A1 | 4/2012 | Lee et al. | |
| 2012/0099255 | A1 | 4/2012 | Lee et al. | |
| 2014/0097733 | A1 | 4/2014 | Seo et al. | |
| 2014/0306592 | A1 | 10/2014 | Hottmann et al. | |

* cited by examiner

APPLIANCE MODULAR SYSTEM FOR INCORPORATING A PANTRY COMPARTMENT WITHIN AN APPLIANCE

FIELD OF THE DEVICE

The present device generally relates to pantry compartments within kitchen appliances, and more specifically, modular pantry systems for installation within kitchen appliances.

BRIEF SUMMARY OF THE SPECIFICATION

In at least one aspect, a refrigerating appliance includes a cabinet structure having a plurality of sidewalls and at least one wall, typically a single medial wall. The plurality of sidewalls, a rear wall, top wall, and bottom wall define an interior volume. The interior volume is typically divided by one or more walls, typically by the medial wall, such that the refrigerating appliance is divided into a refrigerating compartment and a freezing compartment. A horizontal false mullion extends through one of the refrigerating compartment and the freezing compartment and is typically oriented parallel with the medial wall. The medial wall and the horizontal false mullion define a pantry compartment. The pantry compartment is in thermal communication with at least one of the refrigerating compartment and the freezing compartment. A center vertical mullion is removably engaged with the medial wall and extends vertically to the horizontal false mullion. First and second inner drawer glides are defined on opposing sides of the center vertical mullion. The center vertical mullion divides the pantry compartment to define first and second pantry sub compartments. First and second outer drawer glides are positioned proximate opposing internal vertical surfaces of the cabinet structure within the pantry compartment and are positioned opposite the first and second inner drawer glides, respectively. The first inner and first outer drawer glides partially define the first pantry sub compartment. The second inner and second outer drawer glides partially define the second pantry sub compartment. A first pantry drawer is slidably engaged with the first inner and first outer drawer glides and operable within the first pantry sub compartment to define first open and closed positions of the first pantry sub compartment, and a second pantry drawer slidably engaged with the second inner and second outer drawer glides and operable within the second pantry sub compartment to define second open and closed positions of the second pantry sub compartment.

In at least another aspect, a refrigerating appliance includes a cabinet structure including an outer wrapper and at least one inner liner that define an insulating cavity. An insulating material is disposed within the insulating cavity. A medial wall is at least partially defined by the at least one inner liner of the cabinet structure and the medial wall extends through an interior volume defined by the cabinet structure. The medial wall and the at least one inner liner define a refrigerating compartment, which typically has a temperature generally above the freezing temperature of water, and a freezing compartment, which typically has a temperature generally below the freezing temperature of water. A horizontal false mullion extends through the refrigerating compartment. The horizontal false mullion is oriented parallel with the medial wall, and the medial wall and the horizontal false mullion define a pantry compartment. The pantry compartment is in thermal communication with at least one of the refrigerating compartment and the freezing compartment. A center vertical mullion is removably disposed on the medial wall and extends upward to the horizontal false mullion. First and second side adapters are removably positioned against opposing vertical surfaces of the at least one inner liner within the pantry compartment such that the center vertical mullion is positioned between and parallel with the first and second side adapters. The first side adapter and the center vertical mullion define a first pantry sub compartment, and the second side adapter and the center vertical mullion define a second pantry sub compartment. A first pantry drawer is slidably engaged with the first pantry sub compartment and a second pantry drawer slidably engaged with the second pantry sub compartment.

In at least another aspect, a refrigerated pantry conversion kit for dividing a refrigerated pantry compartment into a plurality of pantry sub compartments includes an insulated cabinet structure having an inner liner that defines an interior volume and a medial wall extending through the interior volume to define a refrigerating compartment and a freezing compartment. A horizontal false mullion extends through the refrigerating compartment. The horizontal false mullion is oriented parallel with the medial wall and the medial wall and the horizontal false mullion define a pantry compartment. The pantry compartment is in thermal communication with at least one of the refrigerating compartment and the freezing compartment. A center vertical mullion is removably disposed on the medial wall and extends upward to the horizontal false mullion. The center vertical mullion is selectively removable from the pantry compartment to alternatively define a divided state of the pantry compartment. The center vertical mullion defines first and second pantry sub compartments and an undivided state of the pantry compartment. First and second outer drawer glides are disposed proximate opposing vertical surfaces of the inner liner within the pantry compartment. A full-with pantry drawer is slidably engaged with the first and second outer drawer glides when the pantry compartment is in the undivided state. First and second inner drawer glides are engaged with opposite sides of the center vertical mullion. The first and second inner drawer glides further define the first and second pantry sub compartments when the pantry compartment is in the divided state. First and second pantry drawers are slidably disposed with the first and second pantry sub compartments, respectively, when the pantry compartment is in the divided state.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Figure 1:
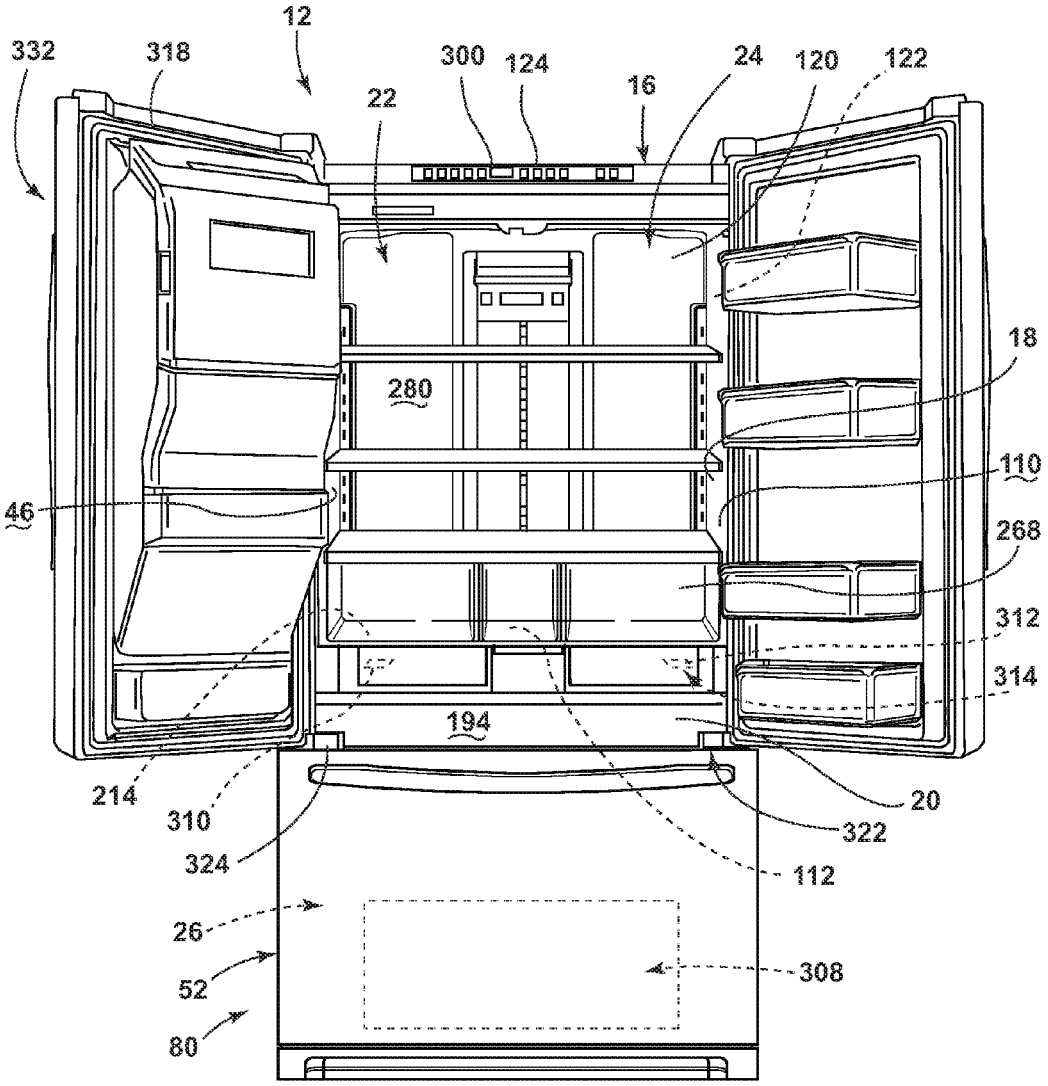
FIG. 1 is a front perspective view of a refrigerating appliance being free of a dedicated pantry compartment.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

With respect to FIGS. 1-10, reference numeral 10 generally refers to a modular pantry compartment system for installation within an appliance, such as a refrigerating appliance 12, where the modular pantry compartment system 10 can define a pantry compartment 14 within the refrigerating appliance 12. According to the various embodiments, such a refrigerating appliance 12 can include a cabinet structure 16 having a plurality of sidewalls 18 and one or more interior dividing walls, such as a medial wall 20. A bottom wall, a top wall and a back wall cooperate with the plurality of sidewalls 18 to define an interior volume 22 of the cabinet structure 16. The interior volume 22 can be divided by the one or more interior dividing walls, such as the medial wall 20, into a plurality of compartments that can include a refrigerating compartment 24 and a freezing compartment 26. One or more horizontal false mullions 28 may extend through one of the refrigerating compartment 24, the freezing compartment 26, or both. The horizontal false mullion 28 is oriented parallel with the medial wall 20. The medial wall 20 and the horizontal false mullion 28 can cooperatively define the pantry compartment 14. The pantry compartment 14 is in thermal communication with at least one of the refrigerating compartment 24 and the freezing compartment 26, or both.

A center vertical mullion 30 can be removably engaged with the one or more interior dividing walls, typically the medial wall 20 and can be configured to extend vertically to the horizontal false mullion 28. First and second inner drawer glides 34 can be defined on opposing sides 36 of the center vertical mullion 30, where the center vertical mullion 30 divides the pantry compartment 14 to define first and second pantry sub compartments 38, 40. First and second outer drawer glides 44 can be positioned proximate the opposing interior vertical surfaces 46 of the cabinet structure 16, within a portion of the pantry compartment 14. The first and second outer drawer glides 44 can be positioned opposite the first and second inner drawer glides 34, respectively. The first inner and first outer drawer glides 32, 42 at least partially define the first pantry sub compartment 38 and the second inner and second outer drawer glides 34, 44 at least partially define the second pantry sub compartment 40. A first pantry drawer 48 is slidably engaged with the first inner and first outer drawer glides 32, 42 and is operable within the first pantry sub compartment 38 to define open and closed positions 50, 52 for the first pantry sub compartment 38. A second pantry drawer 54 is slidably engaged with the second inner and second outer drawer glides 34, 44 and is operable within the second pantry sub compartment 40 to define open and closed positions 50, 52 of the second pantry sub compartment 40.

Referring again to FIGS. 1-10, according to the various embodiments, first and second side adapters 70, 72 can be removably positioned against the opposing interior vertical surfaces 46 of the cabinet structure 16 and within the pantry compartment 14 such that the center vertical mullion 30 is positioned between and parallel with the first and second side adapters 72. It is contemplated that the first outer drawer glide 42 can be coupled with the first side adapter 70 and the second outer drawer glide 44 can be coupled with the second side adapter 72. According to various embodiments, it is contemplated that the center vertical mullion 30 and the first and second side adapters 70, 72 can form at least a portion of the components of the modular pantry compartment system 10. It is contemplated that the modular pantry compartment system 10 can be inserted within a refrigerating appliance 12 to define a pantry compartment 14 within the refrigerating compartment 24 or the freezing compartment 26 of the refrigerating appliance 12. Accordingly, a refrigerating appliance 12 can be pre-manufactured to include only a refrigerating compartment 24 or a freezing compartment 26, or both, and with no pantry compartment 14 (as exemplified in FIG. 1). Subsequent to the manufacture of the refrigerating appliance 12, the refrigerating appliance 12 can be modified through the installation of the modular pantry compartment system 10 to define a pantry compartment 14.

It is also contemplated that the modular pantry compartment system 10 can include the horizontal false mullion 28 that can be disposed within the refrigerating compartment 24 or the freezing compartment 26 of the particular refrigerating appliance 12. Through the use of the modular pantry compartment system 10, a base cabinet structure 80 for a particular refrigerating appliance 12 can be manufactured, and this base cabinet structure 80 can be used in conjunction with the modular pantry compartment system 10 to define a series of different appliance configurations that can be free of a pantry compartment 14 or can include various configurations of the modular pantry compartment system 10. Accordingly, multiple models of a particular appliance can be provided through the use of a single base cabinet structure 80.

According to the various embodiments, as illustrated in FIGS. 1-10, a center vertical mullion 30 and the first and second side adapter 70, 72 of the modular pantry compartment system 10 can be selectively inserted within the cabinet structure 16 to define a divided state 90 of the pantry compartment 14 or an undivided state 92 of the pantry compartment 14. It is also contemplated that the center vertical mullion can be selectively inserted or selectively removed to define either of the divided or undivided states. The divided state 90 is defined by the center vertical mullion 30 being installed therein to divide the pantry compartment 14 into the first and second pantry sub compartments 38, 40 (exemplified in FIG. 3). The undivided state 92 of the pantry compartment 14 is defined by the first and second side adapter 70, 72 being installed within the pantry compartment 14 to define a full-width pantry compartment 94 that can receive a full-width pantry drawer 96 to slidably engage the pantry compartment 14 and the first and second side adapter 70, 72 (exemplified in FIG. 2). Accordingly, the base cabinet structure 80 of the appliance can be modified through the use of the modular pantry compartment system 10 to define either a full-width pantry compartment 94 or a plurality of sub compartments.

According to the various embodiments, as exemplified in FIGS. 1-8, it is contemplated that the modular pantry compartment system 10 can include a single center vertical mullion 30 to define the first and second pantry sub compartments 38, 40. It is also contemplated that the modular pantry compartment system 10 can include a plurality of center vertical mullions 30 to define three or more pantry sub compartments within the pantry compartment 14 of the appliance. It is also contemplated that the position of the one or more center vertical mullions 30 between the first and second side adapter 70, 72 can vary, such that the center vertical mullion 30 can be positioned closer to either of the first or second side adapter 70, 72. In such an embodiment, the center vertical mullion 30 can be configured to provide a first pantry sub compartment 38 that is a different size than the second pantry sub compartment 40 depending upon the positioning of the center vertical mullion 30 between the first and second side adapters 70, 72. In order to secure the position of the center vertical mullion 30 within the cabinet structure 16, the interior surface 110 of the cabinet structure 16 can include a fixing system 112 that receives the center vertical mullion 30 in the plurality of positions between the first and second side adapters 70, 72. Accordingly, the interior surface 110 of the cabinet structure 16 can include a plurality of ridges 114, tabs, clips, recesses 118 or other features that can receive the center vertical mullion 30 at a plurality of positions between the first and second side adapters 70, 72. The interior surface 110 of the cabinet structure 16 can include a sliding mechanism such that the center vertical mullion 30 can be slidably positioned within the pantry compartment 14 to define the first and second pantry sub compartments 38, 40 as well as the size of each of the first and second pantry sub compartments 38, 40.

It is also contemplated that the fixing system 112 can define a pantry receptacle that can be incorporated within the inner liner 120 for the cabinet structure 16 of the refrigerating appliance 12 can include a set of interference or mechanical fasteners that are configured to receive the various components of the modular pantry compartment 14 system 10, included in, but not limited to, the center vertical mullion 30, the first and second side adapter 70, 72. Such fastening mechanisms can include, but are not limited to, protrusions, twist-lock mechanisms, tabs 182, slots, and other similar fastening mechanisms that can substantially secure the various components of the modular pantry compartment system 10 to the inner liner 120 of the refrigerating appliance 12. Through the fixing system 112, the engagement between the various components of the modular pantry compartment system 10 can define a surface to surface engagement or connection that is free of penetrations into the insulating cavity 122. Accordingly, none of the components of the modular pantry compartment system 10 are configured to penetrate through the inner liner 120 of the cabinet structure 16. As such, where the cabinet structure 16 includes a hermetically sealed insulating cavity 122 defined between the inner liner 120 and outer wrapper 124 of a particular cabinet structure 16, the installation of the various components of the modular pantry compartment 14 system 10 are configured to engage the inner liner 120 such that the hermetically sealed insulating cavity 122 of the cabinet structure 16 is maintained in a hermetically sealed configuration during installation of the components of the modular pantry compartment system 10.

Referring again to the various embodiments illustrated in FIGS. 4-10, the position of the center vertical mullion 30 of the modular pantry compartment 14 system 10 can be further defined by the engagement between a front portion 140 of the center vertical mullion 30 that engages the horizontal false mullion 28. In this manner, the center vertical mullion 30 can include an alignment surface 142 that engages at least a bottom portion 144 of the horizontal false mullion 28 such that the front portion 140 of the center vertical mullion 30 is substantially coplanar with the front face 146 of the horizontal false mullion 28. In this manner, the center vertical mullion 30 can extend at least partially under and at least partially surround the horizontal false mullion 28. It is also contemplated that the horizontal false mullion 28 can include one or more securing structures that are configured to engage with the alignment surface 142 of the center vertical mullion 30 to substantially secure the position of the center vertical mullion 30 within the pantry compartment 14. It is contemplated that the horizontal false mullion 28 can include securing structures that cooperate with the interior surface 110 of the cabinet structure 16, as discussed above, to define the position of at least the horizontal false mullion 28 and the center vertical mullion 30 within the pantry compartment 14.

Referring now to the various embodiments illustrated in FIGS. 6-10, the center vertical mullion 30 can include a support interface 160 that can include at least a portion of the alignment surface 142 of the center vertical mullion 30, where the support interface 160 can include a mullion protrusion 162 that at least partially engages with a surface of the horizontal false mullion 28, or, where a pantry cover 210 is used, a portion of the cover walls 230 of the pantry cover 210. It is contemplated that the mullion protrusion 162 can be defined within an upper portion 164 of the center vertical mullion 30 that can extend above adjacent portions of the center vertical mullion 30. In such an embodiment, the upper portion 164 of the center vertical mullion 30 can engage a back surface 166 of the horizontal false mullion 28. It is also contemplated that a portion of the mullion protrusion 162 can extend into a protrusion recess defined within the back surface 166 of the horizontal false mullion 28.

To further secure the position of the center vertical mullion 30 with respect to the horizontal false mullion 28, the center vertical mullion 30 can include a vertical fascia plate 180 that covers a section of the front portion 140 of the center vertical mullion 30. The vertical fascia plate 180 can include a series of tabs 182 that engage at least the front portion 140 of the center vertical mullion 30 and also a bottom portion 144 of the horizontal false mullion 28. In this manner, the tabs 182 of the vertical fascia plate 180 can extend within portions of the horizontal false mullion 28 and the center vertical mullion 30 to act as a securing feature between the horizontal false mullion 28 and the center vertical mullion 30 to secure the components together to define the position of the center vertical mullion 30. It is further contemplated that the vertical fascia plate 180 mullion can include at least one tab 182 that extends into a portion of the medial wall 20 to further secure the position of the center vertical mullion 30 with respect to the cabinet structure 16.

In addition to acting as a securing feature, it is contemplated that the vertical fascia plate 180 can also provide aesthetic functionality. The outer surface 190 of the vertical fascia plate 180, when installed within the modular pantry compartment system 10 and the cabinet structure 16, can provide an outward surface 192 that is substantially coplanar with the front face 146 of the horizontal false mullion 28, such that the horizontal false mullion 28 and the vertical fascia plate 180 can define a substantially coplanar pantry compartment surface. This substantially coplanar surface can also provide a surface to which the first and second pantry drawers 48, 54 can engage and substantially seal off the first and second pantry sub compartments 38, 40 when the first and second pantry drawers 48, 54 are in the closed position 52. Accordingly, the outward surface 192 of the pantry compartment 14 can be substantially coplanar with the outer edge 194 of the cabinet structure 16 to define a substantially continuous sealing surface to which the various door panels can engage to define a substantially sealed closed position 52 of each of the door panels of the refrigerating appliance 12.

Referring again to FIGS. 7 and 8, in order to further secure the position of the center vertical mullion 30 between the first and second side adapters 70, 72, the modular pantry compartment system 10 can include a cross brace 200 that engages the first and second side adapters 70, 72 and engages at least a portion of the center vertical mullion 30. In this manner, the center vertical mullion 30 can include a cross brace receptacle 202 through which a portion of the cross brace 200 can extend. In this manner, the center vertical mullion 30 can be substantially secured to the cross brace 200 at the cross brace receptacle 202 of the center vertical mullion 30. The use of the cross brace 200 can substantially prevent tilting, sliding, angling, or other deflection of the center vertical mullion 30 during installation of the modular pantry compartment system 10 and also during use of the modular pantry compartment system 10 after being installed in the refrigerating appliance 12.

During installation of the modular pantry compartment system 10 within the cabinet structure 16, the cross brace 200 can assist in the positioning of the center vertical mullion 30 to properly position the center vertical mullion 30 within the interior volume 22 of the cabinet structure 16. Accordingly, the center vertical mullion 30 can be slidably moved along the cross brace 200 to achieve the proper position of the center vertical mullion 30 between the first and second side adapter 70, 72. It is contemplated that the cross brace 200 can include a plurality of securing features that can cooperate with the cross brace receptacle 202 of the center vertical mullion 30 to substantially secure the position of the center vertical mullion 30 between the first and second side adapters 70, 72. The various securing features can include, but are not limited to, protrusions, mating features, recesses, tabs, clips, hasps, clasps, notches, magnets, slots, combinations thereof and other similar features.

Referring again to FIGS. 5-7, the modular pantry compartment system 10 can include a pantry cover 210 that is positioned adjacent to and substantially within the same horizontal plane as a top cover surface 212 of the horizontal false mullion 28. It is contemplated that the pantry cover 210 can include the top cover surface 212 that at least partially defines a portion of the floor 214 of the refrigerating compartment 24 of the refrigerating appliance 12. It is also contemplated that a portion of the pantry cover 210 can rest upon the center vertical mullion 30 when the modular pantry compartment system 10 is installed to define the divided state 90 of the pantry compartment 14.

Referring again to FIGS. 5-7, the pantry cover 210 can include an at least partially translucent panel 220 that can be incorporated to allow a user to view the interior of the pantry compartment 14 or at least one of the first and second pantry sub compartments 38, 40 when the pantry compartment 14 is in the closed position 52. In this manner, the refrigerating compartment 24 is in at least visual communication with the pantry compartment 14. It is contemplated that the at least partially translucent panel 220 can include varying degrees of transparency and/or translucency such that the interior volume of the pantry compartment 14 is at least partially visible. Accordingly, the at least partially translucent panel 220 can be at least partially translucent, translucent, at least partially transparent, or fully transparent to allow for the user to view within the pantry compartment 14 when the full-width drawer or at least one of the first and second pantry drawers 48, 54 are in the closed position 52. In this manner, the user can view the contents of the pantry compartment 14 while the user may be looking within the refrigerating compartment 24 to assess the contents of the refrigerating appliance 12. In this manner, the user can view the contents of the pantry compartment 14 through the floor 214 of the refrigerating compartment 24 without allowing cool air (or warm air) from within the pantry compartment 14 from escaping.

Referring again to FIGS. 5-7 and 11, it is contemplated that the pantry cover 210 can include a plurality of cover walls 230 that define a pantry cover interstitial space 232. The pantry cover interstitial space 232 can be a hollowed-out portion of the pantry cover 210 that can contain various functional mechanisms of the modular pantry compartment system 10 and also of the refrigerating appliance 12 as a whole. The pantry cover interstitial space 232 can also be used for additional storage of food items separate from the other refrigerated compartments of the refrigerating appliance 12. It is contemplated that the pantry cover interstitial space 232 can be thermally connected to one of the other environmentally controlled compartments of the refrigerating appliance 12. It is also contemplated that the pantry cover interstitial space 232 can have a dedicated environmental control for setting the temperature, humidity and other environmental parameters of the pantry cover interstitial space 232.

According to the various embodiments, the pantry cover 210 interstitial space 232 can include water-related functionalities that can be placed in communication with the water system of the refrigerating appliance 12. In this manner, the pantry cover interstitial space 232 can house and provide access to the various water-related functionalities that can include, but are not limited to, a water filter 240, a water tank 242, a pantry ice maker 244, a water dispenser, and other similar water-related functionalities. It is also contemplated that at least a portion of the pantry cover interstitial space 232 can include at least a portion of the refrigeration system of the refrigerating appliance 12. In such an embodiment, the pantry cover interstitial space 232 can include a dedicated evaporator 316 and/or air handler 314 that can be configured to transfer cooling from the dedicated evaporator 316 to various portions of the pantry compartment 14. It is also contemplated that a pantry refrigeration system 250 can be used to provide selective and independent amounts of cooling to the first and second pantry sub compartments 38, 40, as will be described more fully below.

Referring again to FIGS. 5-7, the modular pantry compartment system 10 can include a false floor assembly 260 that can be placed upon at least the first and second side adapter 70, 72 when the pantry compartment 14 is configured to be in the undivided state 92. The false floor assembly 260 can also rest upon at least a portion of the center vertical mullion 30 when the pantry compartment 14 is configured in the divided state 90. It is contemplated that the false floor assembly 260 can define a horizontal boundary between the pantry compartment 14 and an adjacent compartment, such as a refrigerating compartment 24 of the refrigerating appliance 12. In this manner, the false floor assembly 260 can define at least a portion of the floor 214 of the refrigerating compartment 24. It is also contemplated that the pantry cover 210, the false floor assembly 260 and the horizontal false mullion 28 can cooperate to define the floor 214 of the refrigerating compartment 24. The false floor assembly 260 can also include a slidable interface 266 upon which a crisper drawer 268 of the refrigerating compartment 24 can rest and upon which such a crisper drawer 268 can slidably operate between various positions. According to various embodiments, the false floor assembly 260 can include various sliding features, rolling guides, guide flanges, and other features that cooperate with a crisper drawer 268 of the refrigerating compartment 24 to the allow the crisper drawer 268 to move between the open and closed position 50, 52 of the crisper drawer 268.

Referring again to the various embodiments illustrated in FIGS. 5-10, it is contemplated that the center vertical mullion 30 can extend between a horizontal false mullion 28 and a back surface 280 of the inner liner 120 of the cabinet structure 16. In such an embodiment, the center vertical mullion 30, the pantry cover 210 and the false floor assembly 260 can define the first and second pantry sub compartments 38, 40 as separate volumes. It is also contemplated that the first and second side adapter 70, 72 and the medial wall 20 of the refrigerating appliance 12 can further define these first and second pantry sub compartments 38, 40 when the pantry compartment 14 is configured in the divided state 90. In such embodiments, the center vertical mullion 30 can define an inner mullion volume 290 where an insulating material 292 can be disposed within the inner mullion volume 290, the center vertical mullion 30 defines an at least partial thermal barrier between the first and second pantry sub compartments 38, 40. It is also contemplated that various other components of the modular pantry compartment system 10 can include an at least partial insulating functionality to substantially prevent thermal transfer from the pantry compartment 14 to one of the other compartments of the refrigerating appliance 12.

Referring again to FIGS. 1-13, the modular pantry compartment system 10 can include a control 300 that is in communication with the pantry refrigeration system 250. In such an embodiment, the control 300 operates the pantry refrigeration system 250 to selectively and independently maintain the first and second pantry sub compartments 38, 40 at respective first and second temperatures 302, 304 when the pantry compartment 14 is configured into the divided state 90. The first and second temperature 302, 304 may be the same or may be different temperatures depending on the temperature settings selected by the user. The control 300 can also be configured to operate the single full-width pantry compartment 94 at a predetermined pantry temperature 306 when the pantry compartment 14 is configured in the undivided state 92. It is contemplated that the pantry control 300 can be configured to operate in conjunction with the divided state 90 and undivided state 92 during assembly of the modular pantry compartment system 10 within the cabinet structure 16 of the refrigerating appliance 12. Accordingly, during installation of the modular pantry compartment system 10, the control 300 can be modified to accommodate either the divided state 90 or the undivided state 92 depending upon the configuration installed within the cabinet structure 16 of the refrigerating appliance 12. It is also contemplated that only one of the first and second pantry sub compartments 38, 40 can receive cooling from a portion of the appliance refrigeration system 308, such as a refrigerator compartment evaporator and/or a freezer compartment evaporator. A damper or other airflow control device can be disposed within a portion of the pantry compartment 14 to direct cooling from the appliance refrigeration system 308 into one of the first and second pantry sub compartments 38, 40.

According to the various embodiments, where both of the first and second pantry sub compartments 38, 40 are dedicated for cooling-type functions, and where only one of the first and second pantry sub compartments 38, 40 receives cooling from the appliance refrigeration system 308, a series of slots 252 (exemplified in FIGS. 6-8) or other apertures are defined within the center vertical mullion 30. These slots 252 can provide for cross air flow between the pantry sub compartment of the first and second pantry sub compartments 38, 40 that receives cooling from the appliance refrigeration system 308 to the other of the first and second pantry sub compartments 38, 40. In this manner, the slots 252 provide for the movement of air flow throughout the pantry compartment 14 and between the first and second pantry sub compartments 38, 40 to limit internal condensation therein. Where the first and second pantry sub compartments 38, 40 are dedicated for separate of generally non-cooperative functions, such as cooling and warming or functions having different temperature or humidity considerations, the slots 252 can be closed. According to various embodiments, the slots 252 can be omitted such that cross ventilation between the first and second pantry sub compartments 38, 40 is not provided, or provided through separate ducting or air handling mechanisms.

According to the various embodiments, the pantry refrigeration system 250 can include a dedicated evaporator installed within a portion of the modular pantry compartment system 10. As discussed above, at least a portion of the pantry refrigeration system 250 can be installed within the pantry cover interstitial space 232 of the pantry cover 210. In such an embodiment, the pantry refrigeration system 250 can include a dedicated evaporator and air handling system that can be in communication with the appliance refrigeration system 308. In this manner, refrigeration lines from the appliance refrigeration system 308 can extend to the pantry refrigeration system 250 to provide cooling to the pantry refrigeration system 250. Accordingly, the pantry refrigeration system 250 can be in communication with a compressor, condenser, expansion device, and other portions of the appliance refrigeration system 308, such that cooling can be delivered to the dedicated evaporator 316 of the pantry refrigeration system 250.

According to various alternate embodiments, as exemplified in FIGS. 1-5, it is contemplated that the pantry refrigeration system 250 can include various ducts 310 that extend between the pantry compartment 14 and an adjacent compartment of the refrigerating appliance 12, such as a refrigerating compartment 24 or a freezing compartment 26. It is also contemplated that the pantry refrigeration system 250 can include ducts 310 having baffles 312 and/or air handlers 314 that can draw cooled air from the refrigerating compartment 24 or freezing compartment 26 for delivery into a portion of the pantry compartment 14. According to various embodiments, it is contemplated that the ducts 310, baffles 312 and air handlers 314 of the pantry refrigeration system 250 can be disposed within the false floor assembly 260, the pantry cover 210, or other components of the modular pantry compartment system 10.

During manufacture of the base cabinet structure 80 that can receive the modular pantry compartment system 10, ducts 310 can be preinstalled within a portion of the cabinet structure 16 to account for the plurality of configurations of the modular pantry compartment system 10 in either the divided or undivided state 90, 92. Accordingly, when the modular pantry compartment system 10 is installed, the preinstalled ductwork within the cabinet structure 16 can place the pantry compartment 14 in communication with either the refrigerating compartment 24, the freezing compartment 26, or both. Alternatively, the various ducts 310 can be installed within the pantry cover 210, the horizontal false mullion 28 or a portion of the false floor assembly 260 of the modular pantry compartment system 10 where these components of the modular pantry compartment system 10 can include the ducts 310, baffles 312, air handlers 314, and other components for delivering cooled air from either the refrigerating compartment 24, the freezing compartment 26, or both, to portions of the pantry compartment 14.

According to the various embodiments, the pantry refrigeration system 250 can be a self-contained unit that includes a dedicated compressor, condenser, expansion device, refrigeration line, evaporator, and refrigerant within at least a portion of the modular pantry compartment system 10. This self-contained system can be included within a portion of the pantry cover 210, such as in the pantry cover interstitial space 232. Where such a unit for the pantry refrigeration system 250 is self-contained, the pantry refrigeration system 250 may only require electrical power to be delivered from the appliance refrigeration system 308 for delivering electrical current to the compressor of the pantry refrigeration system 250.

Referring now to FIGS. 5-13, it is contemplated that a control 300 can be included within a portion of the modular pantry compartment system 10 for operating the pantry refrigeration system 250. The control 300 can be disposed within various portions of the modular pantry compartment system 10 that can include, but are not limited to, the horizontal false mullion 28, the pantry cover 210, a portion of the door panel of either the full-width pantry drawer 96 or the first and second pantry drawers 48, 54. From any one or more of these locations, the control 300 for the modular pantry compartment system 10 can be placed in communication with the pantry refrigeration system 250.

As discussed above, when the modular pantry compartment system 10 is disposed within the cabinet structure 16 of the appliance, the control 300 can be configured to accommodate either the divided or undivided state 90, 92 of the modular pantry compartment system 10. Where the control 300 is disposed within the horizontal false mullion 28, the control 300 can be switched during manufacture, or after market to accommodate one of the divided state 90 and the undivided state 92 to allow for either unified control 300 of a full-width pantry compartment 94, or separate and independent control of the first and second pantry sub compartments 38, 40 of the pantry compartment 14.

Alternatively, the control 300 can be disposed within a portion of either the full-width pantry drawer 96 used for the undivided state 92 of the pantry compartment 14 or within one or both of the first and second pantry drawers 48, 54 of the first and second pantry sub compartments 38, 40. In this manner, when the full-width pantry drawer 96 is installed within the pantry compartment 14 in an undivided state 92, the control 300 that has been preinstalled within the full-width pantry drawer 96 can be connected to the pantry refrigeration system 250 during the installation of the full-width pantry drawer 96 within the pantry compartment 14. Alternatively, where the pantry compartment 14 is configured in the divided state 90, the first and second pantry drawers 48, 54 can be installed within the first and second pantry sub compartments 38, 40 and, thereby, the individual controls 300 can be placed in engagement with the pantry refrigeration system 250. Accordingly, through the installation of the first and second drawers in the respective first and second pantry sub compartments 38, 40, the first and second pantry sub compartments 38, 40 are configured for separate and individual control of the first and second temperatures 302, 304, respectively. In such an embodiment, it may not be necessary to provide alternate configurations of a single control 300 such that the control 300 can be included within the drawers used for the various configurations of the pantry compartment 14.

According to the various embodiments, the control 300 can be used to operate the pantry refrigeration system 250 to define the first and second temperatures 302, 304 of the first and second pantry sub compartments 38, 40 as either the same temperature or as different temperatures depending upon the needs of the user. Accordingly, the pantry compartment 14 and each of the pantry sub compartments 38, 40 can define a refrigerated or freezing pantry space. It is also contemplated that the modular pantry compartment system 10 can include a heating function through which one or both of the first and second pantry sub compartments 38, 40 or the full-width pantry compartment 94 can be configured as a heater/warmer of the refrigerating appliance 12. As discussed above, the various components of the modular pantry compartment system 10, including, but not limited to, the false floor assembly 260, the pantry cover 210, the horizontal false mullion 28, the center vertical wall, the first and second side adapter 70, 72, and other various components of the modular pantry compartment system 10 can include insulative properties that can substantially prevent thermal transfer of either cooling, heating, or both, between the compartments of the modular pantry compartment system 10 and also between the pantry compartment 14 and the refrigerating or freezing compartment 24, 26 of the refrigerating appliance 12.

According to the various embodiments, it is contemplated that a particular refrigerating appliance 12 can include a single modular pantry compartment system 10 disposed therein to define either the full-width pantry compartment 94 or the first and second pantry sub compartments 38, 40. It is also contemplated that the particular appliance can include two or more modular pantry compartment systems 10 that define various pantry compartments 14 and sub compartments within the particular appliance.

By way of example, and not limitation, it is contemplated that a refrigerating appliance 12 can include a refrigerating compartment 24 and a freezing compartment 26 and two separate modular pantry compartment systems 10 disposed within one or both of the refrigerating compartment 24 and the freezing compartment 26. In such an embodiment, two horizontal false mullions 28 may be installed, each defining an upper extent of the particular modular pantry compartment system 10. The remaining components would then be installed within each of the modular pantry compartment systems 10 to define the various compartments and sub compartments of each modular pantry compartment system 10. In such an embodiment, the particular refrigerating appliance 12 can include two French doors 318 that enclose a refrigerating compartment 24, a freezer drawer that encloses a freezing compartment 26, a first full-width pantry drawer 96 that encloses one of the modular pantry compartment systems 10, and first and second pantry drawers 48, 54 that enclose first and second pantry sub compartments 38, 40 of the other modular pantry compartment system 10, thereby making a five-door refrigerating appliance 12. Other configurations of refrigerating, freezing and pantry compartment 24, 26, 14 are also contemplated that may have more than five door panels.

As discussed above, the modular pantry compartment system 10 can include a pantry refrigeration system 250, various water-related functions, and a control 300 that can be coupled with the respective appliance refrigeration system 308, appliance water delivery system and appliance electrical system of the refrigerating appliance 12. In this manner, the various wires, lines, and other services can be run through portions of the modular pantry compartment system 10 to extend to the various electrical and mechanical functions of the modular pantry compartment system 10. Accordingly, the various wires and lines can be run through the horizontal false mullion 28, the pantry cover 210, the center vertical mullion 30, or other portion of the modular pantry compartment system 10 to serve the various mechanical and electrical functions of the modular pantry compartment system 10.

Referring again to FIGS. 1-13, it is contemplated that the modular pantry compartment system 10 can be configured as a refrigerated pantry conversion kit for either adding a pantry compartment 14 to a refrigerating appliance 12 or dividing an existing pantry compartment 14 into first and second pantry sub compartments 38, 40 of the preexisting pantry compartment 14. It is contemplated that the refrigerated pantry conversion kit made up of the various components of the modular pantry compartment system 10 can be used to convert a refrigerating appliance 12 during manufacture, where a base cabinet structure 80 of the refrigerating appliance 12 is converted prior to the sale of the refrigerating appliance 12. It is also contemplated that the modular pantry compartment system 10 can be used as a conversion kit to add a pantry compartment 14 at a retailer or as an after-market conversion kit. Accordingly, a manufacturer, appliance dealer or user can purchase a particular refrigerating appliance 12 and utilize the modular pantry compartment system 10 as a conversion kit to either add a pantry compartment 14 to a refrigerating appliance 12 that previously did not have one, or to convert an existing pantry compartment 14 to include first and second pantry sub compartments 38, 40.

Referring again to FIGS. 5-13, in order to allow for post-manufacture or after-market conversion of a refrigerating appliance 12, the refrigerating appliance 12 can include an interior surface 110 of the cabinet structure 16, such as within the inner liner 120 of the cabinet structure 16, that includes a fixing system 112 having various receiving structures for substantially securing the various components of the modular pantry compartment system 10 therein. This fixing system 112 can include ridges, protrusions, adapters, and other various physical structures that can be used to receive the center vertical mullion 30, the horizontal false mullion 28, the first and second side adapter 70, 72, the pantry cover 210, the false floor assembly 260, and other various aspects of the modular pantry compartment system 10. In such an embodiment, the various components of the modular pantry compartment system 10 can seat within the inner liner 120 of either the refrigerating or freezing compartment 24, 26 of the refrigerating appliance 12, such that the insulating cavity 122 of the cabinet structure 16, which may be hermetically sealed, remains undisturbed as a result of the conversion of the refrigerating appliance 12 to include the modular pantry compartment system 10.

Referring again to FIGS. 5-7, the horizontal false mullion 28 of the modular pantry compartment system 10 can include supplemental hinges 320 that can be used to convert a refrigerating appliance 12 from one that does not include a pantry compartment 14 to one that does. During such a conversion, it is contemplated that the French doors 318 used to enclose the refrigerating compartment 24 must be shorter to accommodate the height of the modular pantry compartment system 10. In this manner, supplemental hinges 320 of the horizontal false mullion 28 can be used to position the shorter doors of the converted appliance. It is contemplated that the supplemental hinges 320 can either be hinges that are either pre-installed upon the horizontal false mullion 28, or can be hinge receptacles 322 to receive the lower hinges 324, that were originally installed within the refrigerating appliance 12 to allow for the hinge receptacles 322 to be relocated from an area proximate the medial wall 20 to within a portion of the horizontal false mullion 28 to accommodate the inclusion of the modular pantry compartment system 10.

Figure 2:
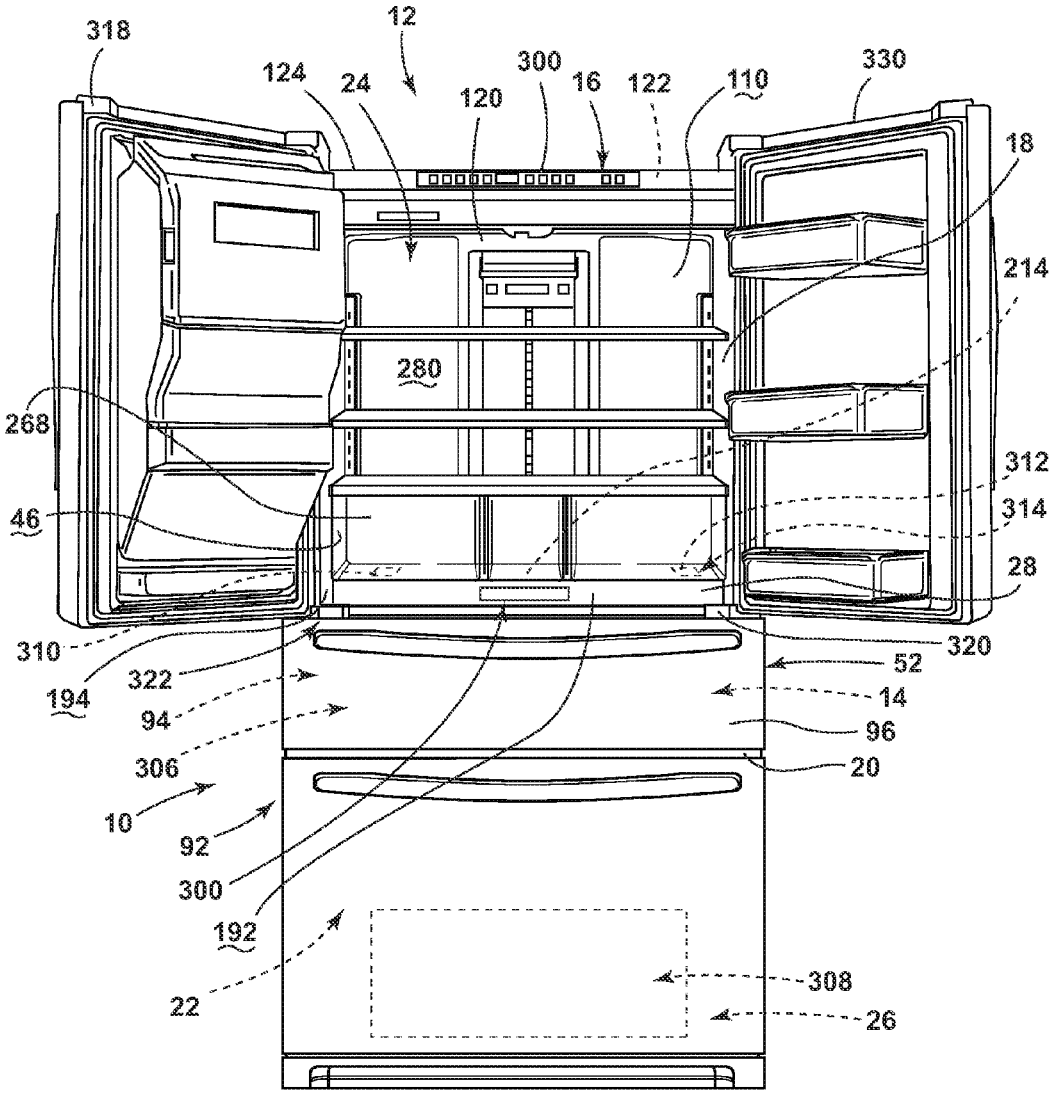
FIG. 2 is a front perspective view of the refrigerating appliance of FIG. 1 shown with an embodiment of the modular pantry compartment system installed therein and configured to include a single full-width pantry drawer, shown in a closed position.
Figure 3:
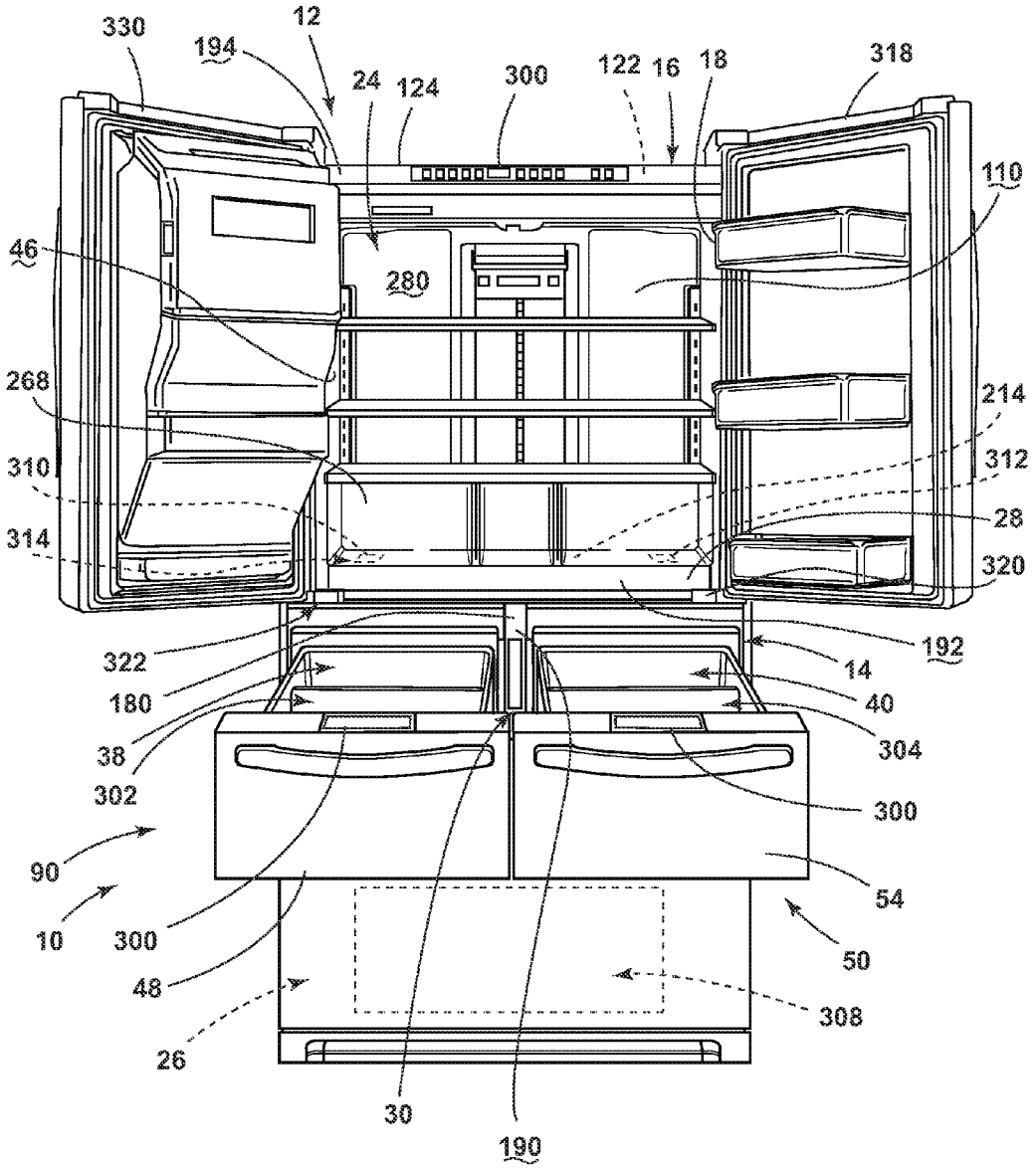
FIG. 3 is a front perspective view of the refrigerating appliance of FIG. 2 with the modular pantry compartment system configured to include first and second pantry sub compartments having respective first and second pantry drawers, each shown in an open position.
Figure 4:
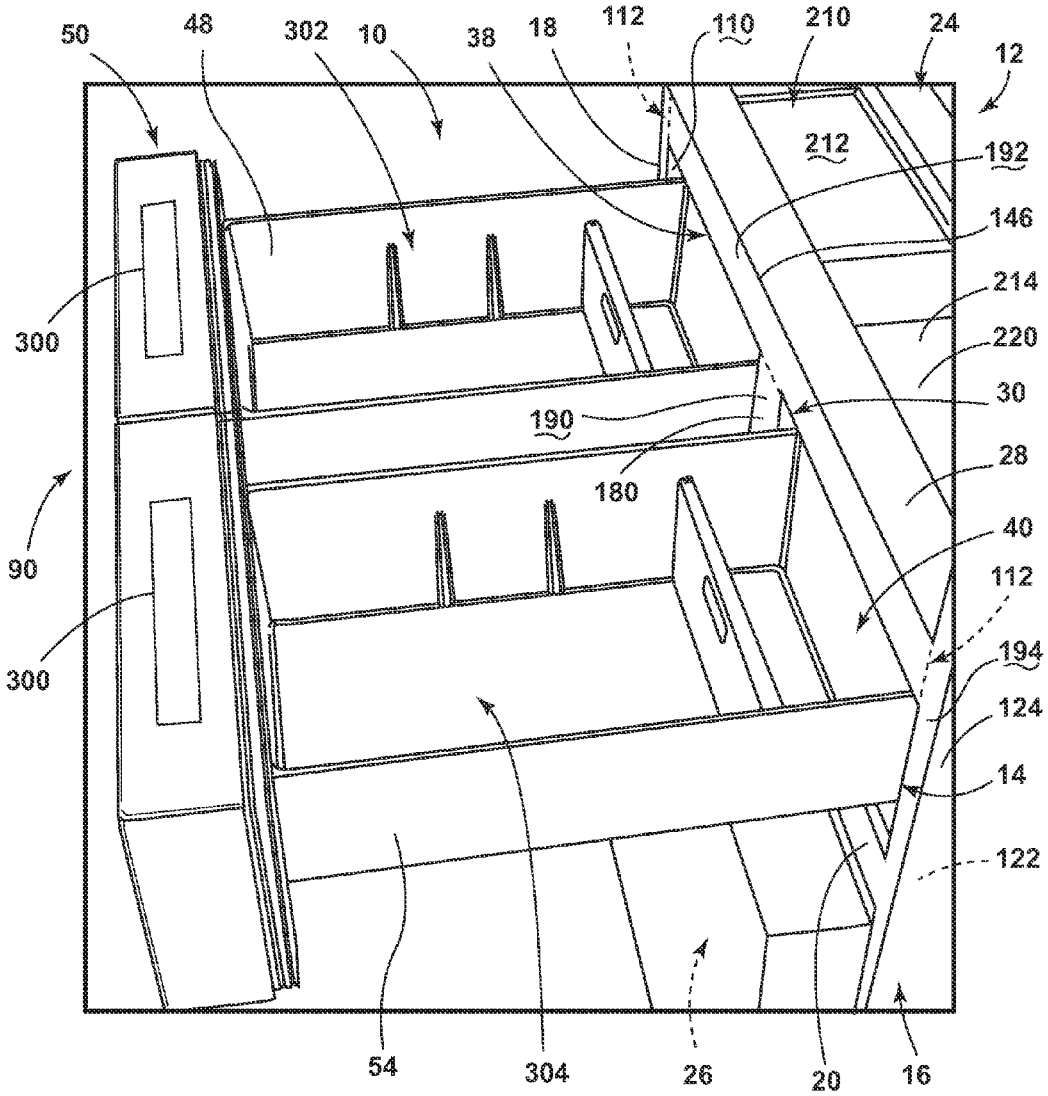
FIG. 4 is a partial top side perspective view of the refrigerating appliance of FIG. 3.
Figure 5:
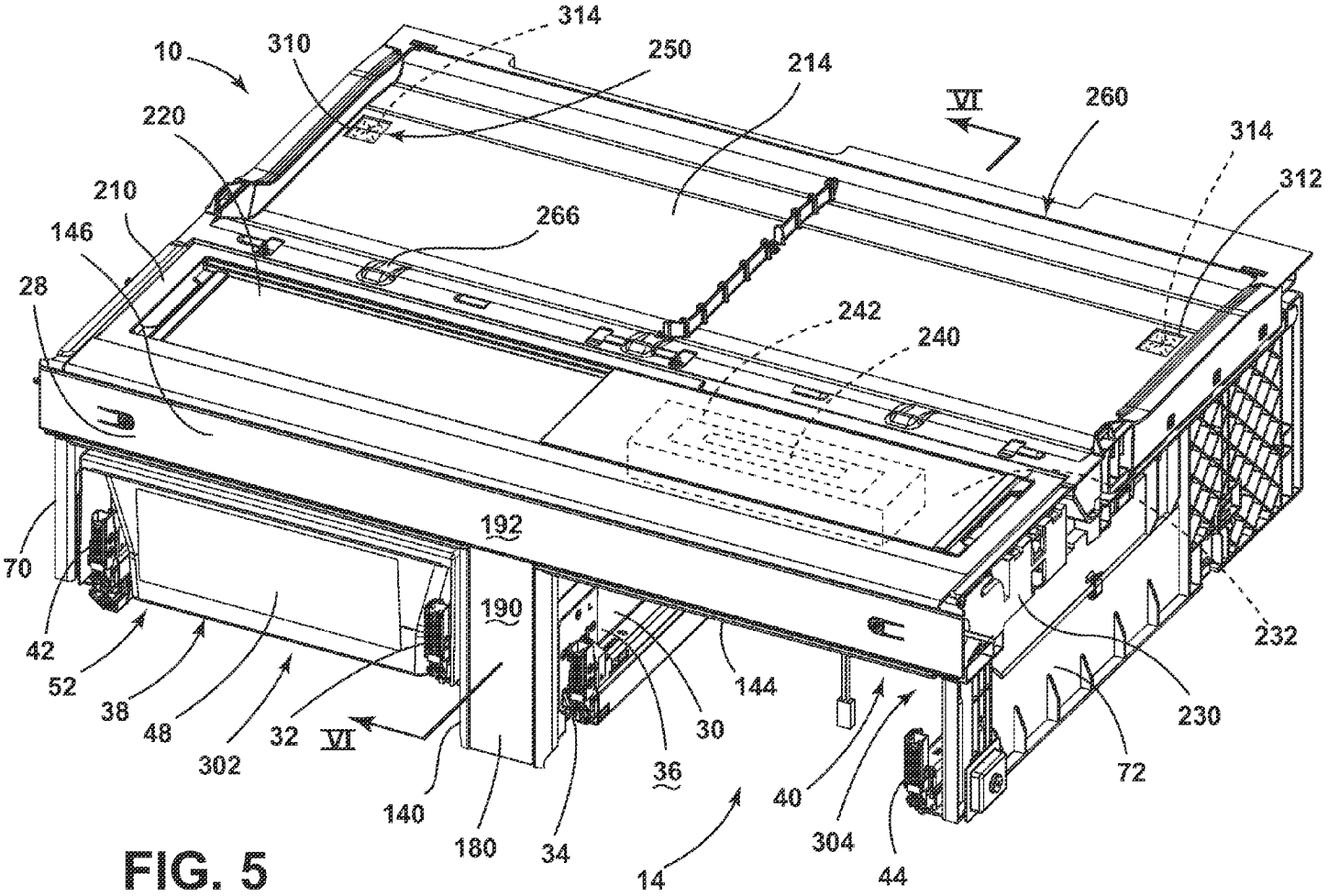
FIG. 5 is a top perspective view of an alternate aspect of the modular pantry compartment system removed from a refrigerating appliance.
Figure 6:
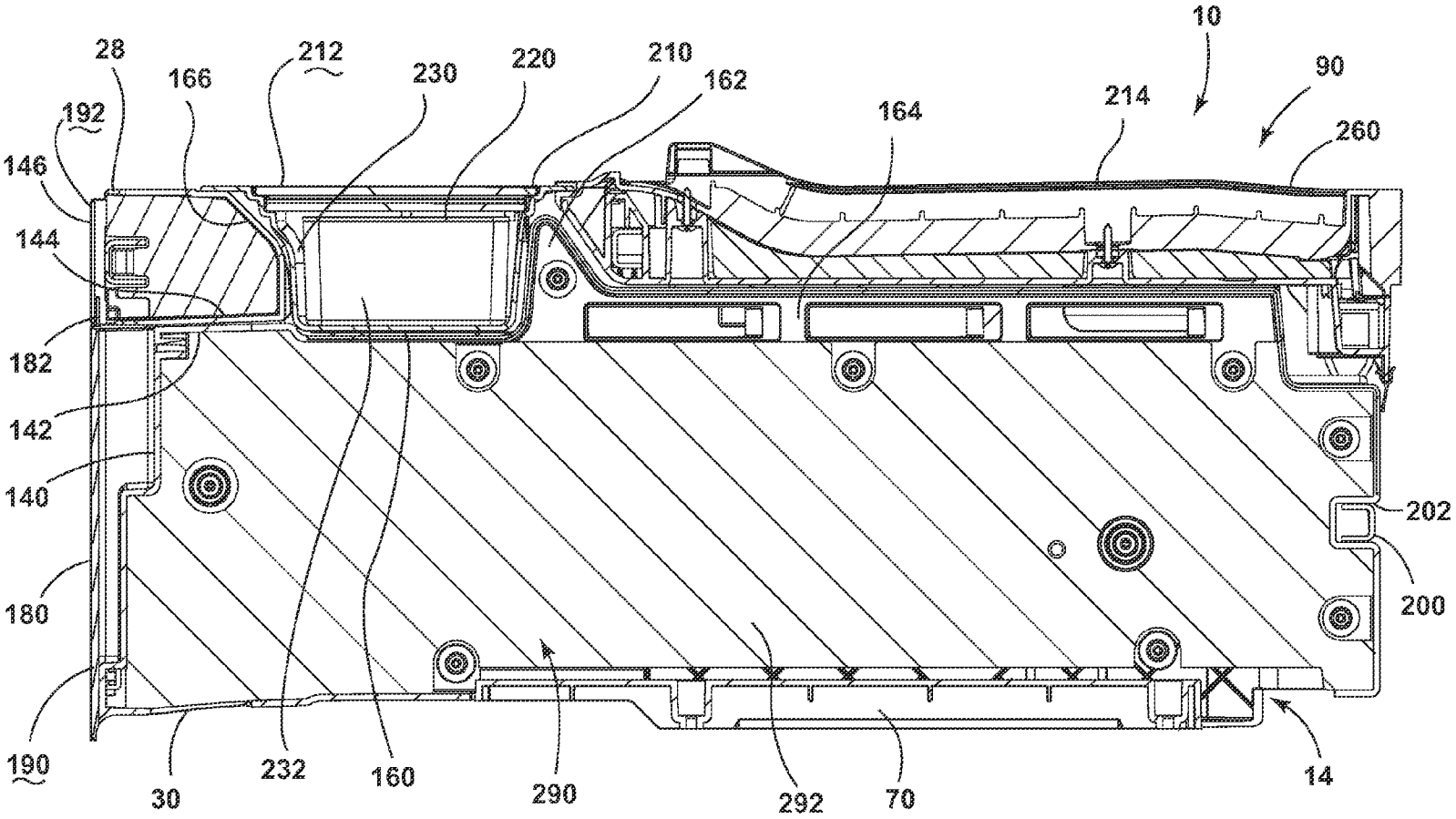
FIG. 6 is a cross-sectional view of the modular pantry compartment system of FIG. 5 taken along line VI-VI.
Figure 7:
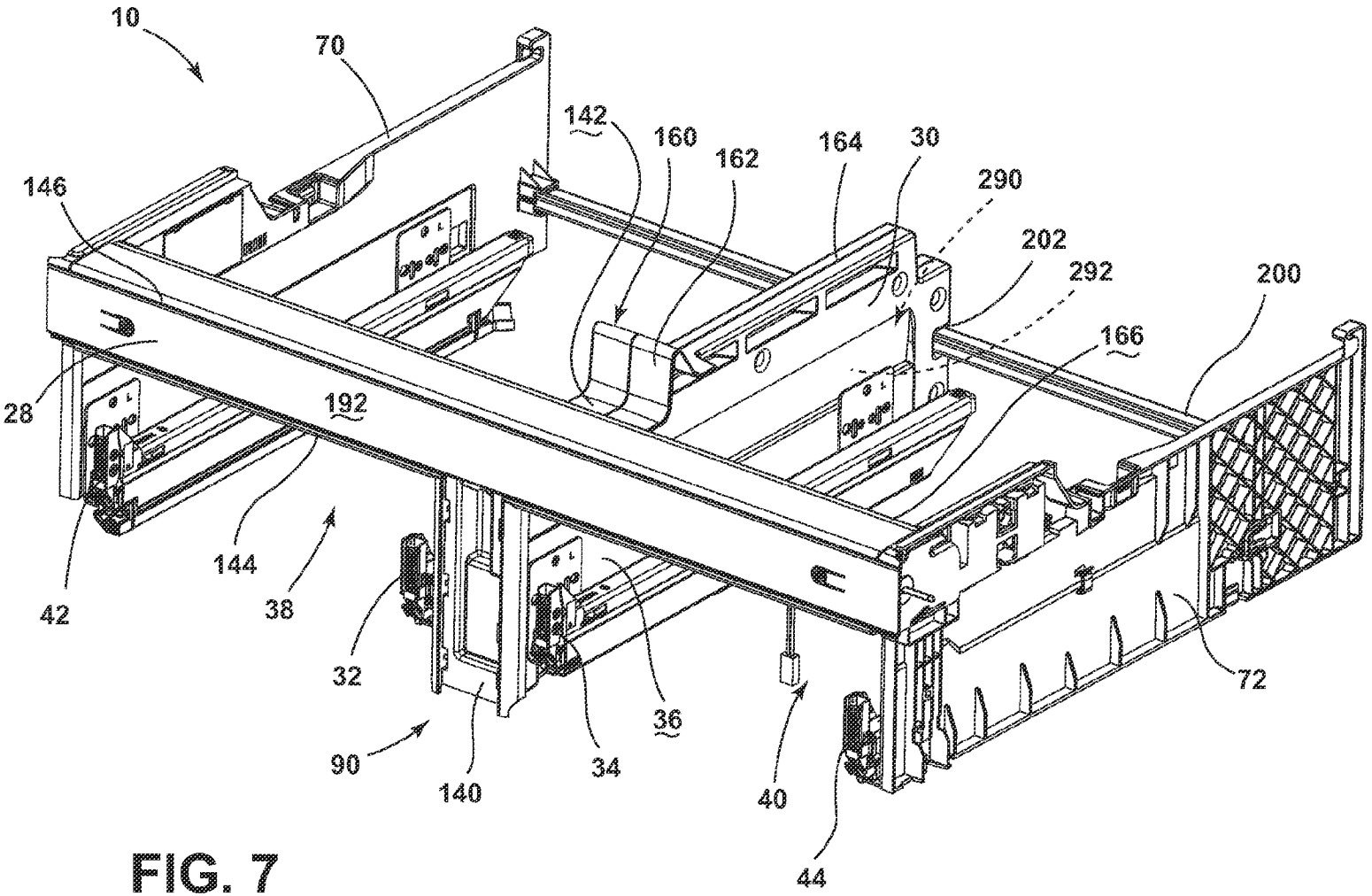
FIG. 7 is a top perspective view of the modular pantry compartment system of FIG. 5 with the pantry cover and false floor assembly removed.
Figure 8:
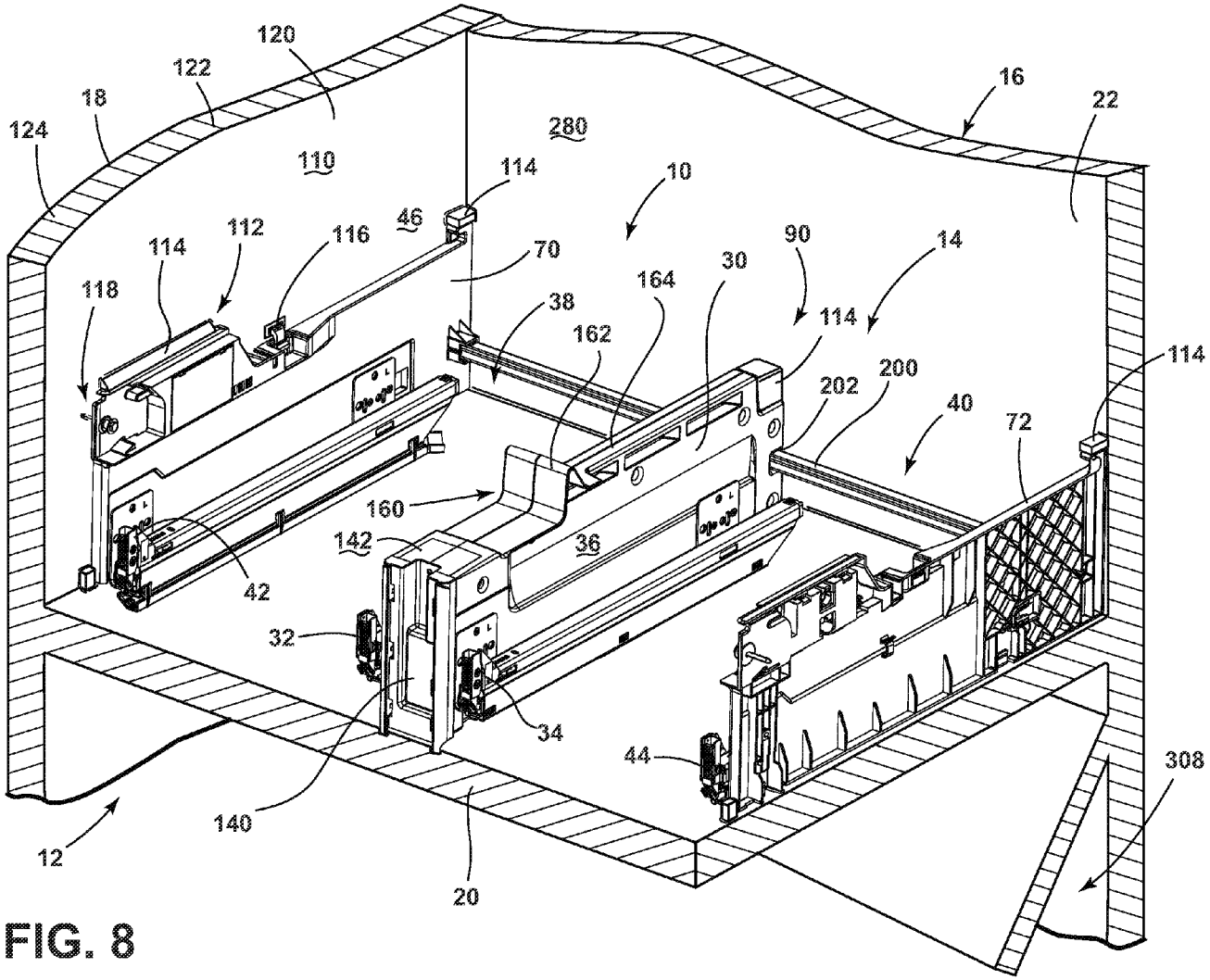
FIG. 8 is a top perspective view of another aspect of the modular pantry compartment system showing the center vertical mullion and the first and second side adapters installed in an appliance having a portion cut away to reveal the engagement between the modular pantry compartment system and the appliance.
Figure 9:
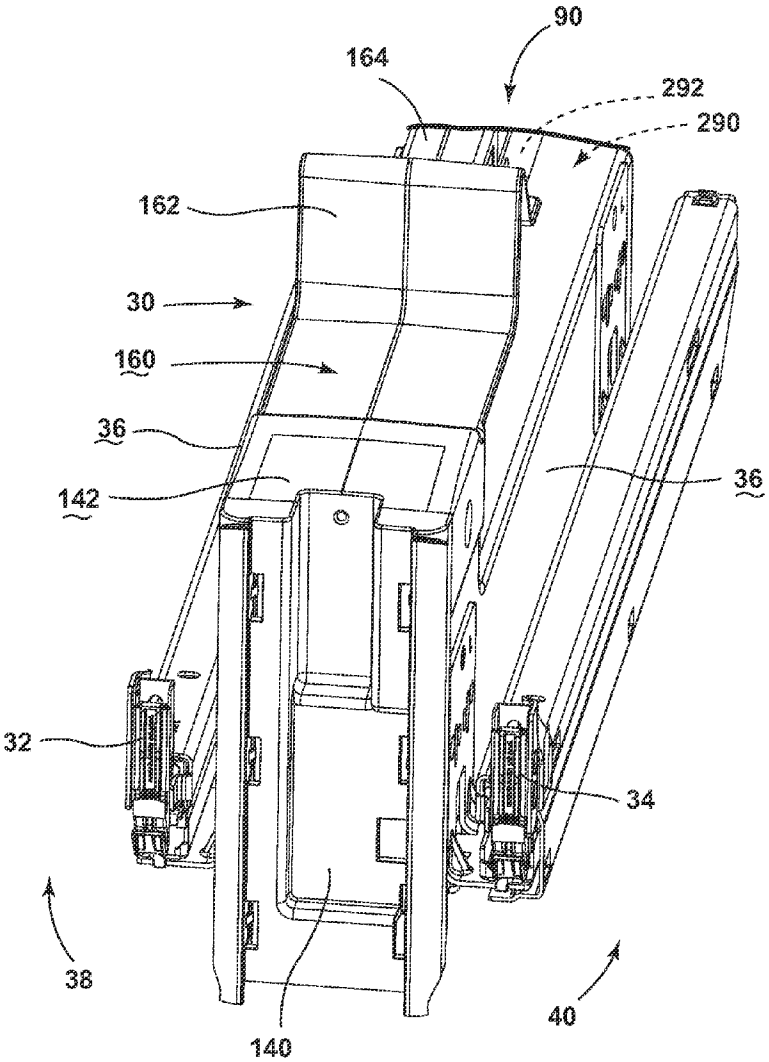
FIG. 9 is a top front perspective view of a portion of the center vertical mullion that is configured to be positioned proximate a false horizontal mullion of the refrigerating appliance.
Figure 10:
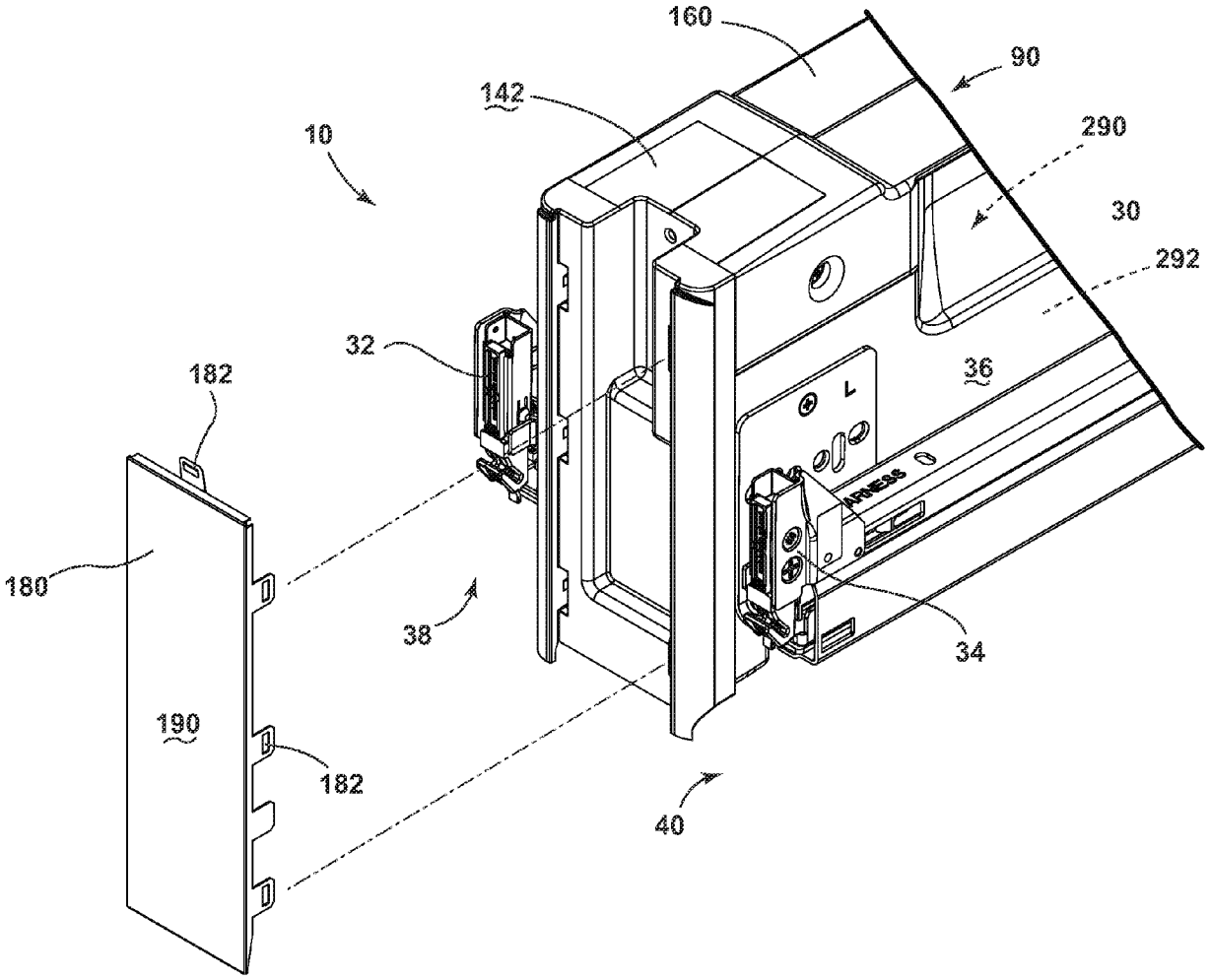
FIG. 10 is a front perspective view of the center vertical mullion of FIG. 8 with the vertical mullion fascia plate removed therefrom.
Figure 11:
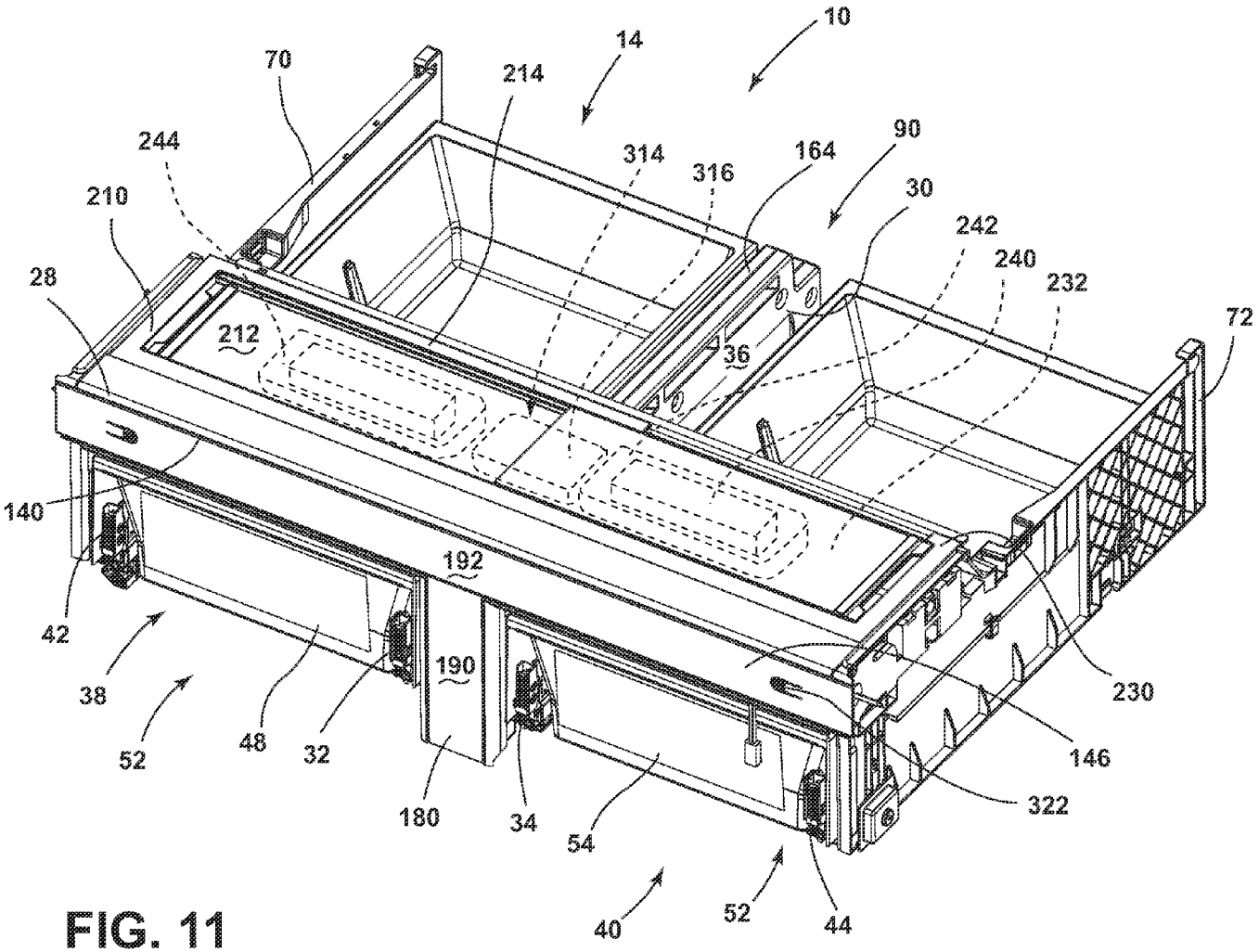
FIG. 11 is a top perspective view of another aspect of the modular pantry compartment system.
Figure 12:
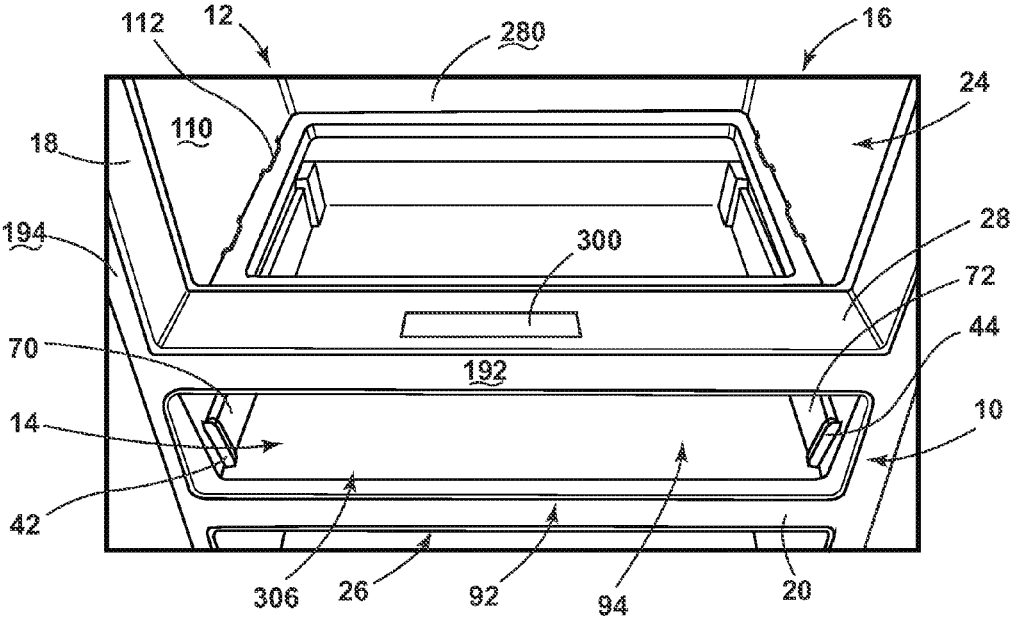
FIG. 12 is a top front perspective view of a refrigerating appliance incorporating an embodiment of the modular pantry compartment system, where the modular pantry compartment system is configured to include a single full-width pantry drawer.
Figure 13:
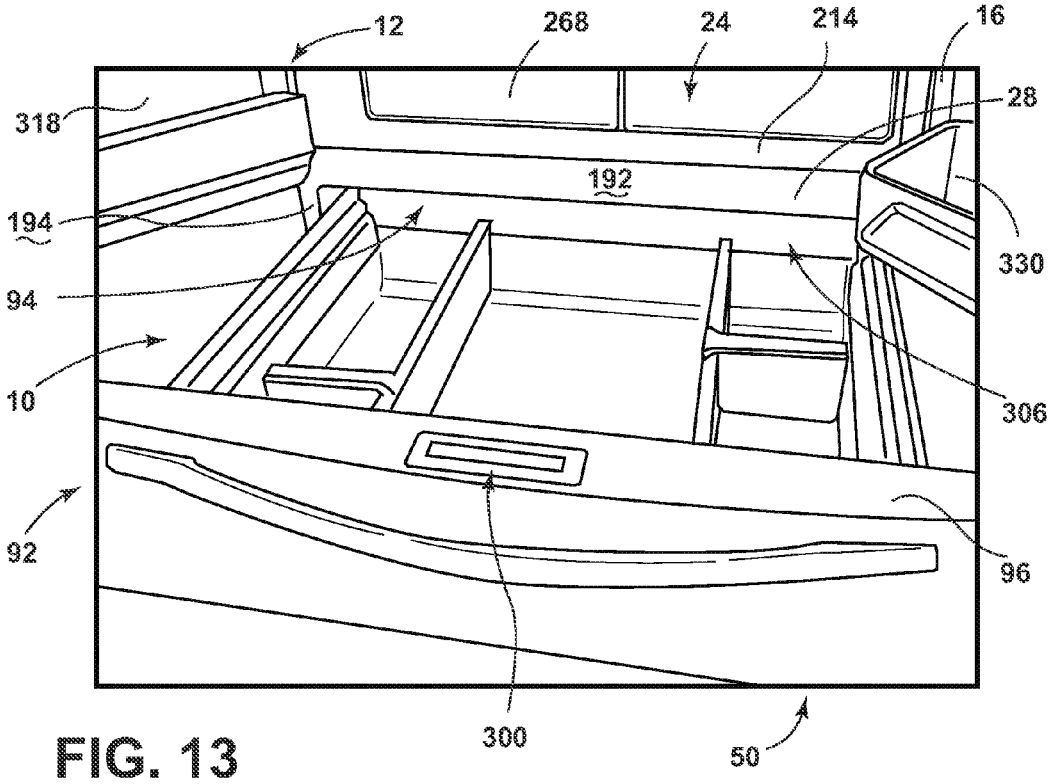
FIG. 13 is a front perspective view of the refrigerating appliance of FIG. 11 with the full-width pantry drawer installed within the modular pantry compartment system.
Figure 14:
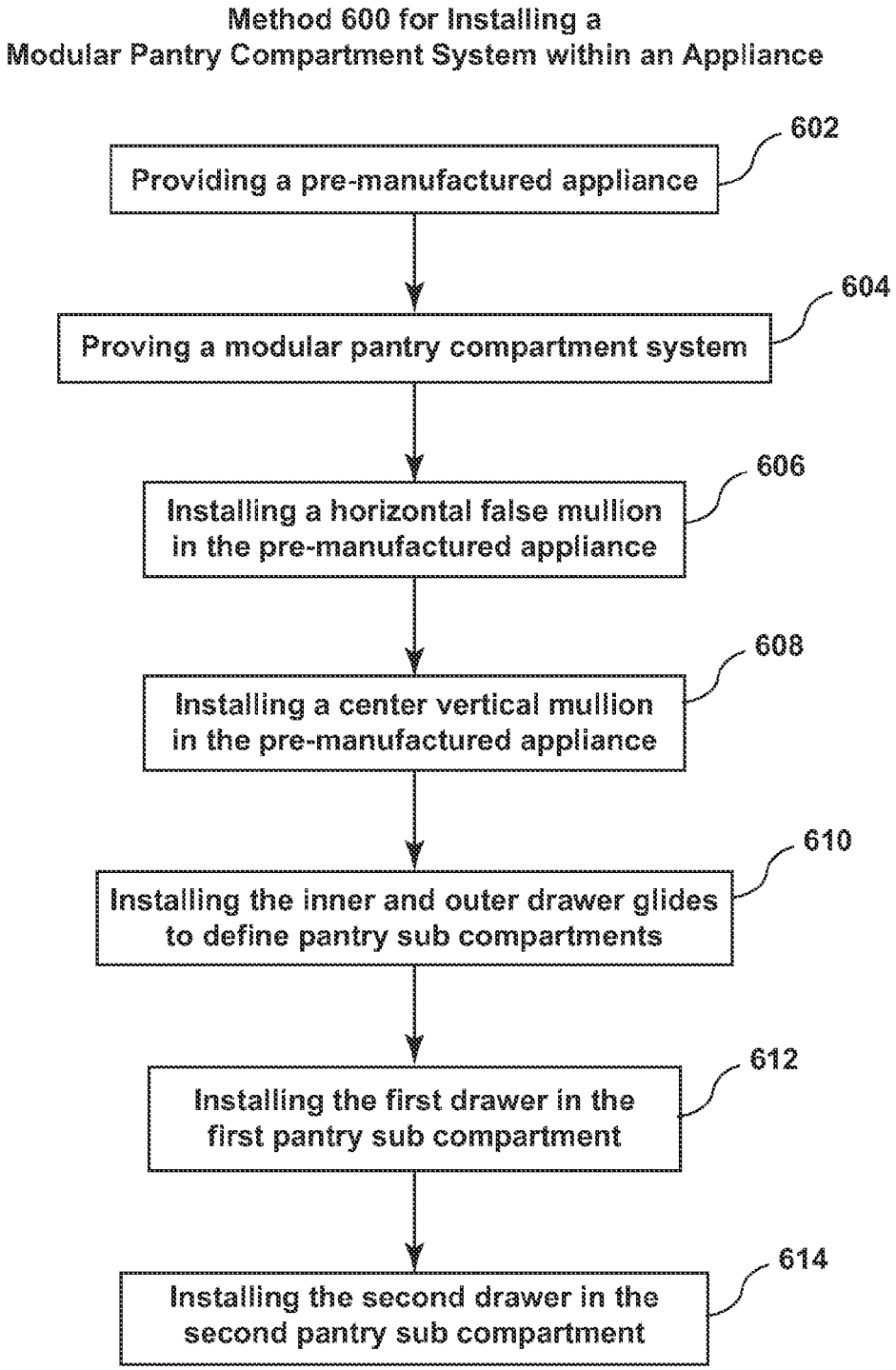
FIG. 14 is a schematic flow diagram illustrating a method for installing a modular pantry compartment system within a refrigerating appliance, according to at least one embodiment.

According to the various embodiments, as illustrated in FIGS. 1-3, the modular pantry compartment system 10 can include a set of pantry-height doors 330 that are configured to be placed proximate the refrigerating compartment 24 of the refrigerating appliance 12 when the appliance 12 includes a pantry compartment 14. A set of no-pantry-height doors 332, that are taller, and that may be originally installed upon a premanufactured refrigerating appliance 12 that does not include a pantry compartment 14. These no-pantry-height doors 332 can be removed, the hinge receptacles 322 moved upward to be in line with the horizontal false mullion 28, and the pantry-height doors 330 for the refrigerating appliance 12 installed thereon when the pantry compartment 14 is installed after manufacture. Accordingly, through the use of the modular pantry compartment system 10, the refrigerator can be fully converted from one that does not include a pantry compartment 14 to one that does.

According to various embodiments, where the modular pantry compartment system 10 is a conversion kit, the pantry refrigeration system 250 can be defined within an upper portion 164 of the modular pantry compartment system 10 that is configured to deliver cool air from the refrigerating compartment 24 to various portions of the pantry compartment 14 or first and second pantry sub compartments 38, 40. In such an embodiment, modifications to the liner of the cabinet structure 16 may not be necessary to allow for the delivery of cooled air from the refrigerating compartment 24 to the modular pantry compartment system 10 as such a cool air delivery system can be defined within the various components of the modular pantry compartment system 10.

Referring now to FIGS. 1-14, having described the various embodiments of the modular pantry compartment system 10 for installing a pantry compartment 14 within a refrigerating appliance 12 or converting a refrigerating appliance 12 to include a pantry compartment 14, a method 600 is disclosed for installing a modular pantry compartment system 10 within a refrigerating appliance 12. According to the method 600, a refrigerating appliance 12 can be provided, where the refrigerating appliance 12 includes a cabinet structure 16 having a plurality of walls and a medial wall 20 that cooperate to define an interior volume 22 that is divided by the medial wall 20 that cooperate to define an interior volume 22, that is divided by the medial wall 20 into a refrigerating compartment 24 and a freezing compartment 26 (step 602). The modular pantry compartment system 10 is also provided (step 604) where the modular pantry compartment 14 system 10 includes at least a horizontal false mullion 28, a center vertical mullion 30 and first and second outer drawer glide 42, 44, wherein the modular pantry compartment system 10 is manufactured separately from the refrigerating appliance 12. It is contemplated that the first and second outer drawer glide 42, 44 can be defined within the first and second side adapter 70, 72. According to various embodiments of the modular pantry compartment system 10, it is also contemplated that the drawer glide system may be incorporated within the premanufactured refrigerating appliance 12. In such an embodiment, the refrigerating appliance 12 may be premanufactured to include a full-width pantry compartment 94 that includes the first and second outer drawer glide 42, 44. In such an embodiment, the modular pantry compartment system 10 can be defined as a refrigerated pantry conversion kit for dividing the pantry compartment 14 into a plurality of pantry sub compartments, such as the first and second pantry sub compartments 38, 40.

Referring again to FIGS. 1-14, according to the method 600, the horizontal false mullion 28 can be installed within one of the refrigerating compartment 24 or the freezing compartment 26, depending upon where the pantry compartment 14 is to be positioned within the refrigerating appliance 12 (step 606). As discussed above, the horizontal false mullion 28 can be oriented parallel with the medial wall 20 where the medial wall 20 and the horizontal false mullion 28 cooperate to define the pantry compartment 14 of the refrigerating appliance 12. The center vertical mullion 30 is also installed and is configured to extend vertically from the medial wall 20 (step 608). It is contemplated that the central vertical wall can be installed either before or after the horizontal false mullion 28. The exact order of the component installation of the modular pantry compartment system 10 can vary depending upon the configuration of the modular pantry compartment system 10 and the configuration of the refrigerating appliance 12, into which the pantry compartment 14 is to be installed. As discussed above, the first and second inner drawer glides 32, 34 are defined on opposite sides of the center vertical mullion 30. Accordingly, the center vertical mullion 30 divides the pantry compartment 14 to define the first and second pantry sub compartments 38, 40.

According to the method 600, the first and second outer drawer glides 42, 44, if not preinstalled, can be installed proximate opposing internal vertical surfaces of the cabinet structure 16 and within the pantry compartment 14. In this manner, the first and second outer drawer glide 42, 44 are positioned opposite the first and second inner drawer glides 32, 34, respectively. As discussed above, the first inner and first outer drawer glides 32, 42 at least partially define the first pantry sub compartment 38 and the second inner and second outer drawer glides 34, 44 partially define the second pantry sub compartment 40 (step 610).

According to the various embodiments, it is contemplated that the center vertical mullion 30, the horizontal false mullion 28 and the first and second side adapters 70, 72 of the modular pantry compartment system 10 can form the structural components of the modular pantry compartment system 10. In this manner, these components can include structural reinforcements defined therein that provide additional structural integrity to these components. Accordingly, the center vertical mullion 30, the horizontal false mullion 28 and the first and second side adapters 70, 72 are designed to include sufficient structural integrity to substantially withstand deformation and damage during installation of the modular pantry compartment system 10 and also during operation of the converted refrigerating appliance 12.

Referring again to FIGS. 1-14, once the first and second pantry sub compartments 38, 40 are defined within the pantry compartment 14, the first pantry drawer 48 is installed within the first pantry sub compartment 38 (step 612) and the second pantry drawer 54 is installed within the second pantry sub compartment 40 (step 614). Accordingly, the first pantry drawer 48 is slidably engaged with the first inner and first outer drawer glides 32, 42 and is operable within the first pantry sub compartment 38 to define open and closed positions 50, 52 of the first pantry sub compartment 38. Similarly, the second pantry drawer 54 is slidably engaged with the second inner and second outer drawer glide 34, 44 and is operable within the second pantry sub compartment 40 between open and closed position 50, 52 of the second pantry sub compartment 40.

During installation of the second vertical mullion and the horizontal false mullion 28, a vertical fascia plate 180 can be installed in a front edge of the center vertical mullion 30 and a lateral surface of the horizontal false mullion 28. As discussed above, the vertical fascia plate 180 can include a plurality of fascia tabs 182 that engage tab receptacles defined at least within the front edge of the center vertical mullion 30 and the second lateral surface of the horizontal false mullion 28. Accordingly, the vertical fascia plate 180 includes a fascia outer surface 190 that is configured to be substantially coplanar with the outward surfaces 192 of the horizontal false mullion 28 and the medial wall 20 when the vertical fascia plate 180 is installed. Through the installation of the vertical fascia plate 180, the fascia outer surface 190 and the outward surfaces 192 of the horizontal false mullion 28 and the medial wall 20, as well as the outer edge 194 of the cabinet structure 16 of the refrigerating appliance 12 define a substantially coplanar surface. This substantially coplanar surface provides a surface to which the various door panels of the refrigerating appliance 12 can engage to substantially seal the various interior compartments of the refrigerating appliance 12.

Figure 15:
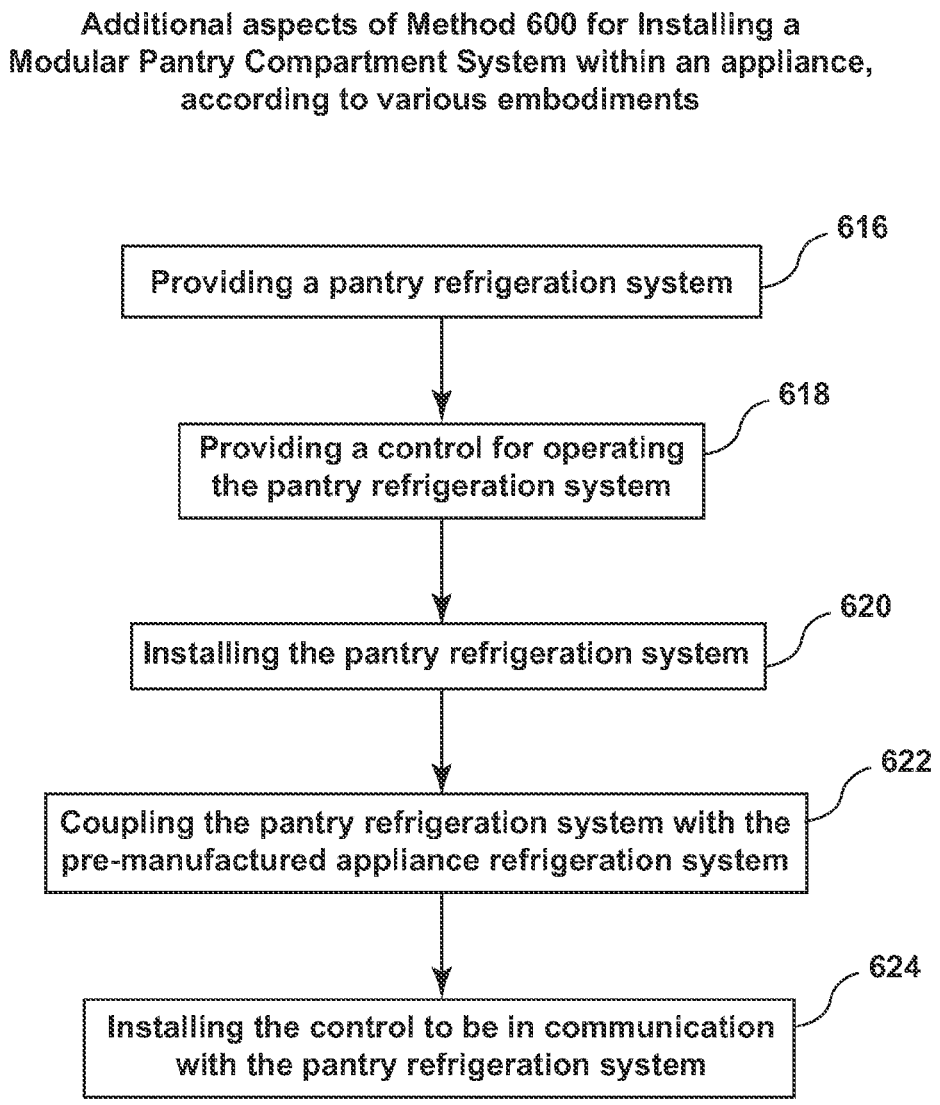
FIG. 15 is a schematic flow diagram illustrating additional aspects of the method of FIG. 14.

Referring now to FIG. 15, additional steps of method 600 can include step 616 of providing a pantry refrigeration system 250 for the modular pantry compartment system 10. As discussed above, the pantry refrigeration system 250 can include ducts 310, baffles 312, air handlers 314, combinations thereof and other air moving features that can be configured to deliver air from the refrigerating compartment 24 or the freezing compartment 26 of the refrigerating appliance 12 to various portions of the pantry compartment 14. Additionally, the pantry refrigeration system 250 can include an evaporator that is incorporated as part of the appliance refrigeration system 308, where thermal cooling can be transferred from the appliance refrigeration system 308 to the pantry evaporator of the pantry refrigeration system 250. Additionally, the pantry refrigeration system 250 can include a self-contained refrigeration system having a dedicated compressor, condenser, expansion device, evaporator and refrigerant in a self-contained unit that only requires electrical power to be delivered from the appliance electrical system for powering the various components of the self-contained pantry refrigeration system 250. In order to operate the pantry refrigeration system 250, a control 300 is also provided (step 618) where the control 300 is configured to be in communication with the pantry refrigeration system 250. According to the method 600, the pantry refrigeration system 250 is installed within a portion of the modular pantry compartment system 10 (step 620) and the pantry refrigeration system 250 can be coupled with the appliance refrigeration system 308 of the refrigerating appliance 12 (step 622). In this manner, the pantry refrigeration system 250 is placed in thermal communication with the appliance refrigeration system 308 for controlling the temperature of the pantry compartment 14.

Referring again to FIG. 15, according to the method 600, the control 300 can be installed within a portion of the modular pantry compartment system 10 (step 624). As discussed above, the control 300 is placed in communication with the pantry refrigeration system 250, such that the control 300 operates the pantry refrigeration system 250 to selectively and independently maintain the first and second pantry sub compartments 38, 40 at respective first and second temperature 302, 304.

According to the various embodiments, it is contemplated that various water-related features can be included within the modular pantry compartment system 10. In this manner, the various water-related features of the modular pantry compartment system 10 can be placed in communication with the water delivery system of the refrigerating appliance 12. In this manner, the water delivery system of the refrigerating appliance 12 can deliver water to at least a water filter 240, a water tank 242, a pantry ice maker 244, and other water-related functions of the modular pantry compartment system 10. These various water-related functions of the modular pantry compartment system 10 can serve functions of the modular pantry compartment system 10 as well as water-related functions of the refrigerating appliance 12 as a whole.

Figure 16:
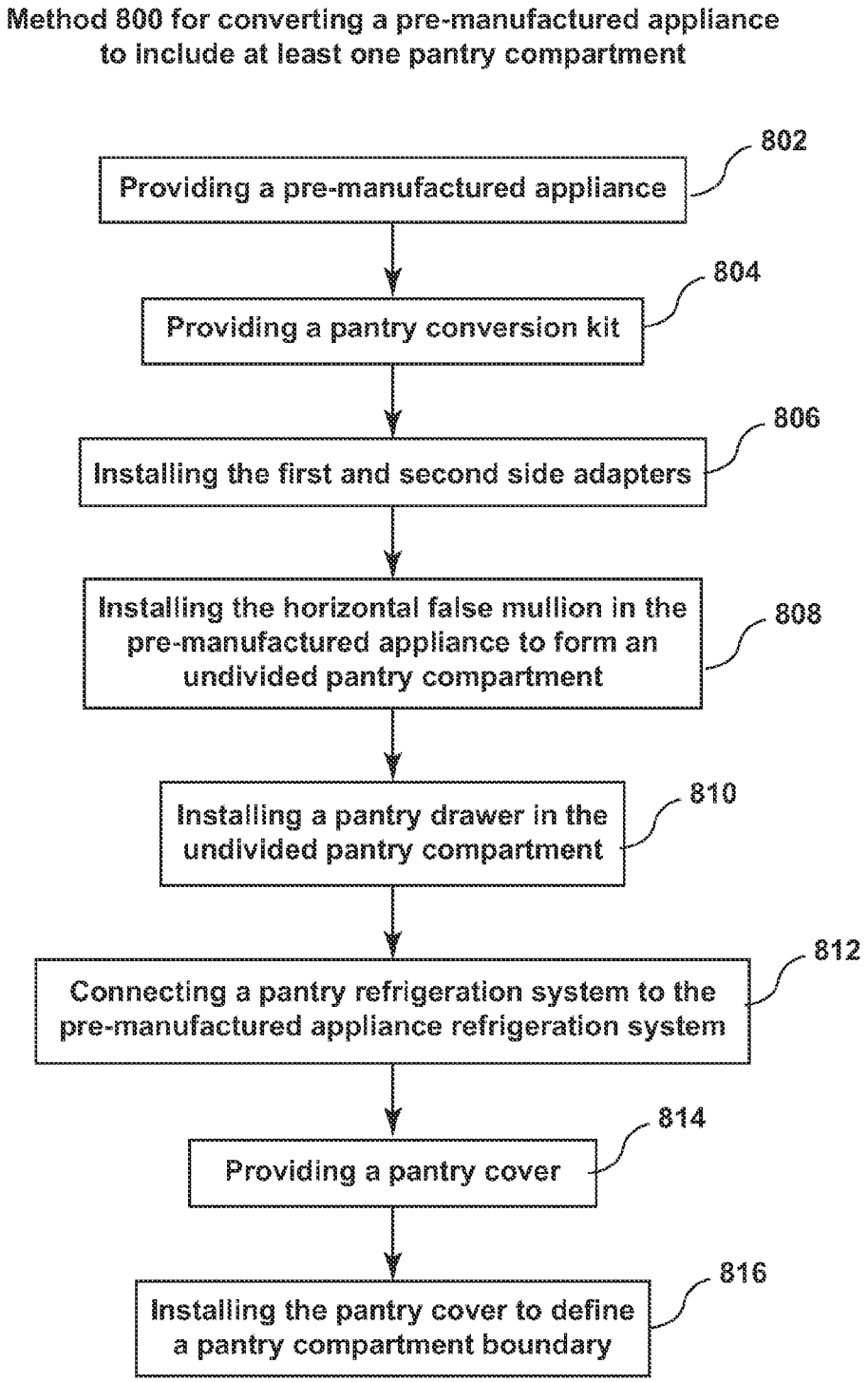
FIG. 16 is a schematic flow diagram illustrating a method for converting a modular pantry compartment system from a single drawer configuration to a multiple drawer configuration, according to at least one embodiment.

Referring now to FIG. 16, a method 800 is also disclosed for converting a premanufactured refrigerating appliance 12 to include a refrigerated pantry compartment 14. Such a method 800 can be used to convert the premanufactured refrigerating appliance 12 from one without a pantry compartment 14 to one with a pantry compartment 14. Additionally, the method can be used to convert a premanufactured refrigerating compartment 24 from one having a single full-width pantry compartment 94 to one having multiple pantry sub compartments defined within the pantry compartment 14. According to the method 800, a premanufactured refrigerating appliance 12 is provided (step 802) where the premanufactured refrigerating appliance 12 has an interior compartment that is in communication with an appliance refrigeration system 308. The modular pantry compartment system 10, in the form of a refrigerated pantry conversation kit, is provided for dividing the interior compartment into a plurality of compartments (step 804). At least a portion of the modular pantry compartment system 10 can include the first and second side adapters 70, 72, a horizontal false mullion 28, at least one pantry drawer, and a pantry refrigeration system 250. These components can be used to convert the premanufactured refrigerating appliance 12 to include a pantry compartment 14 where none existed when the refrigerating appliance 12 was originally manufactured. As discussed above, the modular pantry compartment system 10 can include additional components, such as the central vertical mullion, and other components to provide a pantry compartment 14 having a plurality of sub compartments.

Referring again to FIG. 16, according to the method 800, the first and second side adapters 70, 72 are installed within the interior compartment and engaged to opposing interior vertical surfaces 46 of the premanufactured refrigerating appliance 12 (step 806). As discussed above, the first and second side adapters 70, 72 can include respective first and second outer drawer glide 42, 44 for operating the various pantry drawers of the modular pantry compartment system 10. According to step 808 of the method 800, the horizontal false mullion 28 can be installed between the opposing interior vertical surface 46 of the premanufactured refrigerating appliance 12 and adjacent a front portion 140 of the first and second side adapter 70, 72. In this manner, the first and second side adapter 70, 72 and the horizontal false mullion 28 at least partially divide the interior compartment to define an undivided pantry compartment 14 and a refrigerating compartment 24, with the first and second outer drawer glides 42, 44 positioned within the undivided pantry compartment 14. The at least one pantry drawer is then installed within the undivided pantry compartment 14 (step 810). In this manner, the at least one pantry drawer engages at least one of the first and second outer drawer glides 42, 44.

The pantry refrigeration system 250 is then connected to be in communication with the appliance refrigeration system 308 of the premanufactured refrigerating appliance 12 (step 812). Accordingly, the appliance refrigeration system 308 is placed in communication with the undivided pantry compartment 14.

As discussed above, additional components of the modular pantry compartment system 10 can be installed within the undivided pantry compartment 14 to define two or more pantry sub compartments. In this manner, one or more center vertical mullions 30 can be disposed between the horizontal false mullion 28 and the medial wall 20 to define the plurality of sub compartments.

Referring again to FIG. 16, method 800 can also include step 814 of providing a pantry cover 210 as part of the refrigerated pantry compartment kit. The pantry cover 210 is installed proximate the horizontal false mullion 28 and the first and second side adapters 70, 72 such that horizontal false mullion 28 and the pantry cover 210 define a horizontal boundary between the undivided pantry compartment 14 and the refrigerated compartment (step 816).

As discussed previously, additional components of the modular pantry compartment system 10 that can be used within portions of either method 600 or method 800 can include, but are not limited to, the false floor assembly 260, the first pantry control 300 disposed proximate the first pantry drawer 48, the second pantry control 300 disposed proximate the second pantry drawer 54, the various engagement features defined within the inner liner 120 of the cabinet structure 16 for receiving and substantially securing the various components of the modular pantry compartment system 10, and other various components used to install the modular pantry compartment system 10 within a refrigerating appliance 12 or to convert a premanufactured refrigerating appliance 12 to include, aftermarket, the modular pantry compartment system 10.

The invention claimed is:

1. A method for manufacturing a refrigerating appliance, the method including steps of:

providing the refrigerating appliance including a cabinet structure having a plurality of sidewalls and a medial wall that define an interior volume, the interior volume divided by the medial wall into a refrigerating compartment and a freezing compartment;

providing a modular pantry compartment system including a horizontal false mullion, a center vertical mullion and first and second outer drawer glides, wherein the modular pantry compartment system is manufactured separately from the refrigerating appliance;

installing the horizontal false mullion within one of the refrigerating compartment and the freezing compartment, wherein the horizontal false mullion is oriented parallel with the medial wall, and wherein the medial wall and the horizontal false mullion define a pantry compartment, the pantry compartment in thermal communication with at least one of the refrigerating compartment and the freezing compartment;

installing the center vertical mullion between the horizontal false mullion and the medial wall, wherein the center vertical mullion extends vertically from the medial wall to the horizontal false mullion, wherein first and second inner drawer glides are defined on opposing sides of the center vertical mullion, the center vertical mullion dividing the pantry compartment to define first and second pantry sub compartments;

installing first and second outer drawer glides positioned proximate opposing internal vertical surfaces of the cabinet structure within the pantry compartment and positioned opposite the first and second inner drawer glides, respectively, wherein the first inner and first outer drawer glides partially define the first pantry sub compartment, and wherein the second inner and second outer drawer glides partially define the second pantry sub compartment;

installing a first pantry drawer within the first pantry sub compartment, wherein the first pantry drawer is slidably engaged with the first inner and first outer drawer glides and operable within the first pantry sub compartment to define open and closed positions of the first pantry sub compartment; and installing a second pantry drawer within the second pantry sub compartment, wherein the second pantry drawer is slidably engaged with the second inner and second outer drawer glides and operable within the second pantry sub compartment between open and closed positions of the second pantry sub compartment.

2. The method of claim 1, wherein the step of installing the center vertical mullion includes installing a vertical fascia plate on a front edge of the center vertical mullion and a lateral surface of the horizontal false mullion, wherein the vertical fascia plate includes a plurality of fascia tabs that engage tab receptacles defined at least within the front edge of the center vertical mullion and the lateral surface of the horizontal false mullion, wherein the vertical fascia plate includes a fascia outer surface that is substantially coplanar with outward surfaces of the horizontal false mullion and the medial wall when the vertical fascia plate is installed.

3. The method of claim 1, wherein the first and second outer drawer glides are defined within first and second side adapters that are installed against the opposing internal vertical surfaces of the cabinet structure within the pantry compartment such that the center vertical mullion is positioned between and parallel with the first and second side adapters.

4. The method of claim 1, further comprising steps of:

providing a pantry refrigeration system for the modular pantry compartment system;

providing a control configured to be in communication with the pantry refrigeration system;

installing the pantry refrigeration system within a portion of the modular pantry compartment system;

coupling the pantry refrigeration system with an appliance refrigeration system of the refrigerating appliance, wherein the pantry refrigeration system is in thermal communication with the appliance refrigeration system;

installing the control within a portion of the modular pantry compartment system wherein the control is in communication with the pantry refrigeration system, wherein the control operates the pantry refrigeration system to selectively and independently maintain the first and second pantry sub compartments at respective first and second temperatures, wherein the pantry refrigeration system includes ducts that selectively deliver cooled air from at least one of the refrigerating compartment and the freezing compartment to the pantry compartment, wherein the control operates the ducts to maintain the first and second pantry sub compartments at the first and second temperatures.

5. The method of claim 1, further including the step of:

providing a pantry cover and a false floor assembly as part of the modular pantry compartment system;

installing the pantry cover and the false floor assembly proximate the horizontal false mullion and the center vertical mullion, and wherein the pantry cover and the false floor assembly define a horizontal boundary between the refrigerating compartment and the pantry compartment, wherein a portion of the false floor assembly rests upon the center vertical mullion, and wherein the pantry cover, the false floor assembly and the horizontal false mullion cooperate to define a floor of the refrigerating compartment.

6. The method of claim 3, wherein the cabinet structure of the refrigerating appliance includes an outer wrapper, an inner liner and an insulating cavity disposed between the outer wrapper and the inner liner, wherein the inner liner of a premanufactured refrigerating appliance includes a pantry receptacle configured to securely receive the first and second side adapters, the center vertical mullion and the horizontal false mullion, wherein engagement of the pantry receptacle with the first and second side adapters, the center vertical mullion and the horizontal false mullion defines a surface engagement that is free of penetrations that extend into the insulating cavity of the cabinet structure.

7. The method of claim 6, wherein the insulating cavity is manufactured as a hermetically sealed insulating cavity, and wherein installation of the first and second side adapters, the center vertical mullion and the horizontal false mullion substantially maintains the insulating cavity as a hermetically sealed cavity during installation of the modular pantry compartment system.

8. A method for converting a refrigerated appliance to include a refrigerated pantry compartment, the method comprising steps of:

providing a premanufactured refrigerating appliance having an interior compartment that is in communication with an appliance refrigeration system;

providing a refrigerated pantry conversion kit for dividing the interior compartment into a plurality of compartments, wherein at least a portion of the refrigerated pantry conversion kit includes first and second side adapters, a horizontal false mullion, at least one pantry drawer and a pantry refrigeration system;

installing the first and second side adapters within the interior compartment within opposing interior vertical surfaces of the premanufactured refrigerating appliance, wherein the first and second side adapters include respective first and second outer drawer glides;

installing the horizontal false mullion between the opposing interior vertical surfaces and adjacent a front portion of the first and second side adapters, wherein the first and second side adapters and the horizontal false mullion at least partially divides the interior compartment to define an undivided pantry compartment and a refrigerated compartment, wherein the first and second outer drawer glides are positioned within the undivided pantry compartment;

installing the at least one pantry drawer to engage at least one of the first and second outer drawer glides; and connecting the pantry refrigeration system to be in communication with the appliance refrigeration system of the premanufactured refrigerating appliance, wherein the appliance refrigeration system is in communication with the undivided pantry compartment.

9. The method of claim 8, wherein the premanufactured refrigerating appliance includes a cabinet structure having an outer wrapper, an inner liner and an insulating cavity disposed between the outer wrapper and the inner liner, the insulating cavity being manufactured as a hermetically sealed insulating cavity, wherein the inner liner of the premanufactured refrigerating appliance includes a pantry receptacle configured to securely receive the first and second side adapters and the horizontal false mullion, wherein engagement of the pantry receptacle with the first and second side adapters and the horizontal false mullion defines a surface engagement that is free of penetrations that extend into the insulating cavity of the cabinet structure, and wherein installation of the first and second side adapters and the horizontal false mullion maintains the insulating cavity as a hermetically sealed cavity during installation of the refrigerated pantry conversion kit.

10. The method of claim 8, wherein the at least one pantry drawer includes a full-width pantry drawer, wherein when the full-width pantry drawer is installed within the undivided pantry compartment, the full-width pantry drawer engages the first and second outer drawer glides.

11. The method of claim 10, wherein the full-width pantry drawer includes a control in operable communication with the pantry refrigeration system, wherein the step of installing the at least one pantry drawer includes placing the control in operable communication with the pantry refrigeration system, wherein the control operates the pantry refrigeration system to maintain the undivided pantry compartment at a predetermined pantry temperature.

12. The method of claim 8, further comprising the step of:

providing a pantry cover as part of the refrigerated pantry conversion kit; and installing the pantry cover proximate the horizontal false mullion and the first and second side adapters, and wherein the horizontal false mullion and the pantry cover define a horizontal boundary between the undivided pantry compartment and the refrigerated compartment.

13. The method of claim 12, wherein the pantry refrigeration system is at least partially disposed within the pantry cover.

14. The method of claim 12, wherein the premanufactured refrigerating appliance includes a water delivery system, and wherein the pantry cover includes at least one of a water filter, a water tank and a pantry ice maker, wherein the step of installing the pantry cover includes placing the pantry cover in communication with the water delivery system of the premanufactured refrigerating appliance.

15. The method of claim 8, further comprising the step of:

providing a false floor assembly as part of the refrigerated pantry conversion kit; and installing the false floor assembly proximate the horizontal false mullion and the first and second side adapters, and wherein the horizontal false mullion and the false floor assembly define a horizontal boundary between the undivided pantry compartment and the refrigerated compartment.

16. The method of claim 8, wherein the step of providing the refrigerated pantry conversion kit includes providing a center vertical mullion having first and second inner drawer glides disposed thereon and wherein the at least one pantry drawer includes first and second pantry drawers, wherein the first pantry drawer is configured to engage the first inner and first outer drawer glides, and the second pantry drawer is configured to engage the second inner and second outer drawer glides, the method further including steps of:

installing the center vertical mullion between the first and second side adapters, wherein the center vertical mullion divides the undivided pantry compartment into first and second pantry sub compartments; and installing the first pantry drawer into the first pantry sub compartment and installing the second pantry drawer into the second pantry sub compartment.

17. The method of claim 16, wherein the refrigerated pantry conversion kit includes a control disposed within a portion thereof, wherein the control is in communication with the pantry refrigeration system to selectively and independently maintain the first and second pantry sub compartments at respective first and second temperatures.

18. The method of claim 17, wherein the control includes a first pantry control disposed proximate the first pantry drawer and in communication with the pantry refrigeration system to maintain the first pantry sub compartment at a first temperature and second pantry control disposed proximate the second pantry drawer and in communication with the pantry refrigeration system to maintain the second pantry sub compartment at a second temperature.

19. A method for converting a refrigerated pantry compartment to include a plurality of pantry sub compartments, the method comprising steps of:

providing a premanufactured refrigerating appliance having a pantry compartment that is in communication with an appliance refrigeration system, wherein the pantry compartment includes first and second outer drawer glides;

providing a refrigerated pantry conversion kit for dividing the pantry compartment into the plurality of pantry sub compartments, wherein at least a portion of the refrigerated pantry conversion kit includes a center vertical mullion, first and second pantry drawers, and a pantry refrigeration system, wherein the center vertical mullion includes first and second inner drawer glides;

installing the center vertical mullion within the pantry compartment to define first and second pantry sub compartments within the pantry compartment, wherein the first inner and outer drawer glides are positioned within the first pantry sub compartment to receive the first pantry drawer, and wherein the second inner and outer drawer glides are positioned within the second pantry sub compartment to receive the second pantry drawer;

installing the first and second pantry drawers into the respective first and second pantry sub compartments; and connecting the pantry refrigeration system to be in communication with the appliance refrigeration system, wherein the appliance refrigeration system is in communication with the first and second pantry sub compartments.

20. The method of claim 19, wherein the premanufactured refrigerating appliance includes a cabinet structure having an outer wrapper, an inner liner and an insulating cavity disposed between the outer wrapper and the inner liner, the insulating cavity being manufactured as a hermetically sealed insulating cavity, wherein the inner liner of the premanufactured refrigerating appliance includes a pantry receptacle configured to securely receive the center vertical mullion, wherein engagement of the central vertical mullion and the pantry receptacle defines a surface engagement that is free of penetrations that extend into the insulating cavity of the cabinet structure, and wherein installation of the center vertical mullion maintains the insulating cavity as a hermetically sealed cavity during installation of the refrigerated pantry conversion kit.

* * * * *